US007564365B2

(12) United States Patent
Marman et al.

(10) Patent No.: US 7,564,365 B2
(45) Date of Patent: Jul. 21, 2009

(54) SMOKE DETECTOR AND METHOD OF DETECTING SMOKE

(75) Inventors: Douglas H. Marman, Ridgefield, WA (US); Frederick W. Eggers, Oregon City, OR (US)

(73) Assignee: GE Security, Inc., Bradenton, FL (US)

( * ) Notice: Subject to any disclaimer, the term of this patent is extended or adjusted under 35 U.S.C. 154(b) by 98 days.

(21) Appl. No.: 11/389,746

(22) Filed: Mar. 28, 2006

(65) Prior Publication Data

US 2006/0261967 A1 Nov. 23, 2006

Related U.S. Application Data

(63) Continuation-in-part of application No. 10/645,354, filed on Aug. 20, 2003, now Pat. No. 7,075,445.

(60) Provisional application No. 60/405,599, filed on Aug. 23, 2002.

(51) Int. Cl.
*G08B 17/10* (2006.01)
*G01N 21/00* (2006.01)

(52) U.S. Cl. ..... 340/628; 340/630; 356/338; 356/435

(58) Field of Classification Search ..... 340/628–630; 356/335–338, 435, 437, 438
See application file for complete search history.

(56) References Cited

U.S. PATENT DOCUMENTS 3,316,410 A 4/1967 Meili et al.
3,566,385 A 2/1971 Lawson
3,739,365 A 6/1973 Müller
3,748,014 A 7/1973 Beiser
3,765,842 A 10/1973 Purt
3,872,315 A 3/1975 Boll
3,874,795 A * 4/1975 Packham et al. ..... 356/341
3,880,526 A 4/1975 Kobayashi et al.
3,921,158 A 11/1975 Anderson et al.
3,922,655 A 11/1975 Lecuyer
3,982,130 A 9/1976 Trumble
3,994,603 A 11/1976 Paschedag
4,206,456 A 6/1980 Malinowski et al.
4,221,485 A 9/1980 Schulze
4,230,950 A * 10/1980 Forss et al. ..... 250/574
4,300,133 A 11/1981 Solomon
4,420,746 A * 12/1983 Malinowski ..... 340/630
4,426,640 A * 1/1984 Becconsall et al. ..... 340/632
4,436,619 A 3/1984 Petrov et al.
4,547,675 A 10/1985 Muggli et al.
4,651,013 A 3/1987 Kajii et al.

(Continued)

FOREIGN PATENT DOCUMENTS

EP 0 290 413 9/1988

(Continued)

*Primary Examiner*—Jennifer Mehmood
(74) *Attorney, Agent, or Firm*—Global Patent Operation

(57) ABSTRACT

A smoke detector that includes at least one image-forming reflective surface, at least one light source and at least one light sensor. In operation, at least one light source emits light from a first area thereon and the reflective surface focuses the light onto a second area that includes at least one light sensor, wherein the first area is smaller than the second area.

23 Claims, 13 Drawing Sheets

U.S. PATENT DOCUMENTS

| | | | | | |
|---|---|---|---|---|---|
| 4,675,661 | A | | 6/1987 | Ishii et al. | |
| 4,839,527 | A | | 6/1989 | Leitch | |
| 4,857,895 | A | | 8/1989 | Kaprelian | |
| 5,009,493 | A | | 4/1991 | Koch et al. | |
| 5,079,422 | A | | 1/1992 | Wong | |
| 5,103,096 | A | | 4/1992 | Wong | |
| 5,341,214 | A | * | 8/1994 | Wong | 356/437 |
| 5,502,434 | A | | 3/1996 | Minowa et al. | |
| 5,546,074 | A | | 8/1996 | Bernal et al. | |
| 5,565,984 | A | * | 10/1996 | Girvin | 356/336 |
| 5,576,697 | A | | 11/1996 | Nagashima et al. | |
| 5,798,701 | A | | 8/1998 | Bernal et al. | |
| 5,841,534 | A | | 11/1998 | Lorenz | |
| 6,011,478 | A | | 1/2000 | Suzuki et al. | |
| 6,107,925 | A | * | 8/2000 | Wong | 340/628 |
| 6,225,910 | B1 | | 5/2001 | Kadwell et al. | |
| 6,377,345 | B1 | | 4/2002 | Powell | |
| 6,788,197 | B1 | * | 9/2004 | Thuillard et al. | 340/522 |
| 6,876,305 | B2 | | 4/2005 | Kadwell et al. | |
| 2003/0011770 | A1 | * | 1/2003 | Cole | 356/338 |

FOREIGN PATENT DOCUMENTS

| | | |
|---|---|---|
| EP | 0 321 265 | 6/1989 |
| JP | 52-080880 | 7/1977 |
| JP | 2001-34863 | 2/2001 |
| WO | WO 99/19852 | 4/1999 |
| WO | WO 00/07161 | 2/2000 |

* cited by examiner

SMOKE DETECTOR AND METHOD OF DETECTING SMOKE

CROSS-REFERENCE TO RELATED APPLICATIONS

This application claims priority to and is a continuation-in-part of U.S. patent application entitled, RAPIDLY RESPONDING, FALSE DETECTION IMMUNE ALARM SIGNAL PRODUCING SMOKE DETECTOR, filed Aug. 20, 2003, having a Ser. No. 10/645,354, now U.S. Pat. No. 7,075,445 (issued Jul. 11, 2006), the disclosure of which is hereby incorporated herein in its entirety by reference and which itself claims priority to provisional U.S. patent application entitled, RAPIDLY RESPONDING, FALSE DETECTION IMMUNE ALARM SIGNAL PRODUCING SMOKE DETECTOR, filed Aug. 23, 2002, having a Ser. No. 60/405,599, the disclosure of which is also hereby incorporated herein in its entirety by reference.

FIELD OF THE INVENTION

The present invention relates generally to smoke detectors and to fire detection methods. More particularly, the present invention relates to obscuration-type smoke detectors and to methods of using the same.

BACKGROUND OF THE INVENTION

Ionization-type smoke detectors and photoelectric-type smoke detectors are currently available. In an ionization-type smoke detector, a very low ionic current is generated in the detector's detection chamber and the current flows from one side of the detection chamber to the opposite side thereof. A stream of air also flows through the detection chamber. When particles, including smoke particles, are entrained in the stream of air, these particles alter the flow of the ionic current. Then, when a change in the ionic current flow is detected by a sensor that is included in the smoke detector, the sensor activates an alarm indicating the presence of smoke particles.

In a photoelectric-type smoke detector, a light source, typically in the form of a Light Emitting Diode (LED), and a light sensor are mounted at an acute angle relative to each other inside of the detector's detection chamber. As such, the light sensor is shielded from stray light from the light source. When smoke particles enter the detection chamber, light emitted by the light source is scattered by the smoke particles, the scattered light is detected by the light sensor and an alarm is activated.

Ionization-type smoke detectors are sensitive to relatively small (i.e., less than about 1.0 micron in diameter) airborne particles produced during the early phases of flaming fires. As such, ionization-type smoke detectors typically respond to flaming fires faster than do photoelectric-type smoke detectors. However, some types of smoke particles (i.e., smoke particles that do not disrupt the ionic current very much) are more likely to be sensed by a photoelectric-type smoke detector than an ionization-type smoke detector.

In view of the above, when an ionization-type smoke detector is configured to be sensitive even to smoke particles that only slightly disrupt the ionic current therein, the detector will be overly sensitive to the presence of smoke particles that substantially disrupt the ionic current. Thus, ionization-type smoke detectors tend to have a high incidence of false alarms. For example, ionization-type smoke detectors sound alarms when they detect small, non-smoke particles such as cooking, cleaning fluid and paint fume particles.

Photoelectric-type smoke detectors, on the other hand, respond relatively quickly to relatively large (i.e., greater than about 1.0 micron in diameter) smoke particles generated by smoldering fires. However, because the color of the smoke particles greatly affects the amount of light that the particles scatter, photoelectric-type smoke detectors respond to the presence of black smoke much more slowly than they respond to the presence of white smoke.

In addition to the shortcomings mentioned above, ionization-type and photoelectric-type smoke detectors also suffer from a number of other shortcomings. For example, both of these types of detectors are highly sensitive to dust and dirt accumulation in their detection chambers.

In ionization-type smoke detectors, the presence of dust particles decreases conductivity and thereby distorts the ionic current flow. In photoelectric-type smoke detectors, dust particles that accumulate on the detection chamber walls scatter light onto the light sensor and thereby cause false alarms and increase background noise. Further, when a dust particle layer accumulates on the sides, top and/or bottom of the detection chamber in a photoelectric-type smoke detector, the presence of the layer increases the reflectivity of the wall relative to a conventional black detection chamber wall. Hence, stray light propagating from the light source reflects off of the dust layer and increases the amount of light that reaches the light sensor. The light sensor, in turn, responds to this increase by producing an output that indicates the presence of smoke particles and consequently activates an alarm.

Because the presence of dust in smoke detectors cannot be avoided, most commercial fire codes mandate that regular testing and cleaning procedures be instituted to avoid excessive dust accumulation. Unfortunately, cleaning a detector is expensive, inconvenient and/or time-consuming. Therefore, some smoke detectors have been designed to minimize the amount of dust that settles on the walls of the detection chamber of a smoke detector. However, the overall cost and complexity of such smoke detectors is relatively high.

Among the other shortcomings of ionization-type and photoelectric-type smoke detectors are their sensitivities to wind and outside light sources. In view of these shortcomings, ionization-type detectors cannot be used in air ducts or near wind drafts because the excessive air flow can blow the ions out of the detection chamber. To reduce the effect of wind drafts and outside light, photoelectric-type detectors generally include partitions and walls that block dust and light emitted by outside light sources. However, these partitions and walls often significantly decrease the flow of air carrying smoke particles into the detection chamber, thereby reducing the responsiveness of the detector.

One attempt to provide a smoke detector with an increased sensitivity and a reduced incidence of false alarms entailed creating a combination ionization-type/photoelectric-type smoke detector. When combined in a logical "OR" configuration, the combination smoke detector responded more rapidly to many different types of smoke. However, the incidence of false alarms increased. When combined in a logical "AND" configuration, the incidence of false alarms was reduced. However, the combination smoke detector displayed decreased sensitivity to many of the different types of smoke. Therefore, neither combination was entirely successful.

What is needed, therefore, is an improved smoke detector that is consistently sensitive to a wide range of smoke types (e.g., small-diameter smoke particles, large-diameter smoke particles, smoke particles of different colors) while exhibiting a reduced incidence of false alarms. What is also needed are methods for detecting this wide range of smoke types while also reducing the incidence of false alarms.

SUMMARY OF THE INVENTION

The foregoing needs are met, to a great extent, by embodiments of the present invention. According to one embodiment of the present invention, a smoke detector is provided. The smoke detector includes a first light source configured to emit, from a first area thereon, light in a first wavelength range. The smoke detector also includes a first light sensor configured to detect the light in the first wavelength range. The smoke detector further includes a reflective surface configured to focus the light in the first wavelength range onto a second area that includes the first light sensor, wherein the second area is larger than the first area.

According to another embodiment of the present invention, a method of monitoring smoke concentration is provided. The method includes emitting light in a first wavelength range from a first area on a first light source. The method also includes focusing the light in the first wavelength range onto a second area, wherein the second area is larger than the first area and includes a first light sensor. The method further includes detecting how much of the light in the first wavelength range reaches the first light sensor.

According to yet another embodiment of the present invention, another smoke detector is provided. This other smoke detector includes means for emitting light in a first wavelength range from a first area on a first light source. This other smoke detector also includes means for focusing the light in the first wavelength range onto a second area, wherein the second area is larger than the first area and includes a first light sensor. This other smoke detector further includes means for detecting how much of the light in the first wavelength range reaches the first light sensor.

Among the advantages of smoke detectors and methods according to certain embodiments of the present invention is that they can be configured to be sensitive to all smoke colors, they can be configured to be relatively small in size and of relatively low complexity and they can be configured to require no cleaning during their lifetime (e.g., approximately 20 years). They can also be configured to be relatively low in cost and to be relatively easy to manufacture. In addition, they can be configured to automatically calibrate themselves, to detect relatively small particles and/or to measure particle size. Further, they can be configured to be used in air duct and/or other locations with a high rate of air flow.

DETAILED DESCRIPTION

Figure 1:
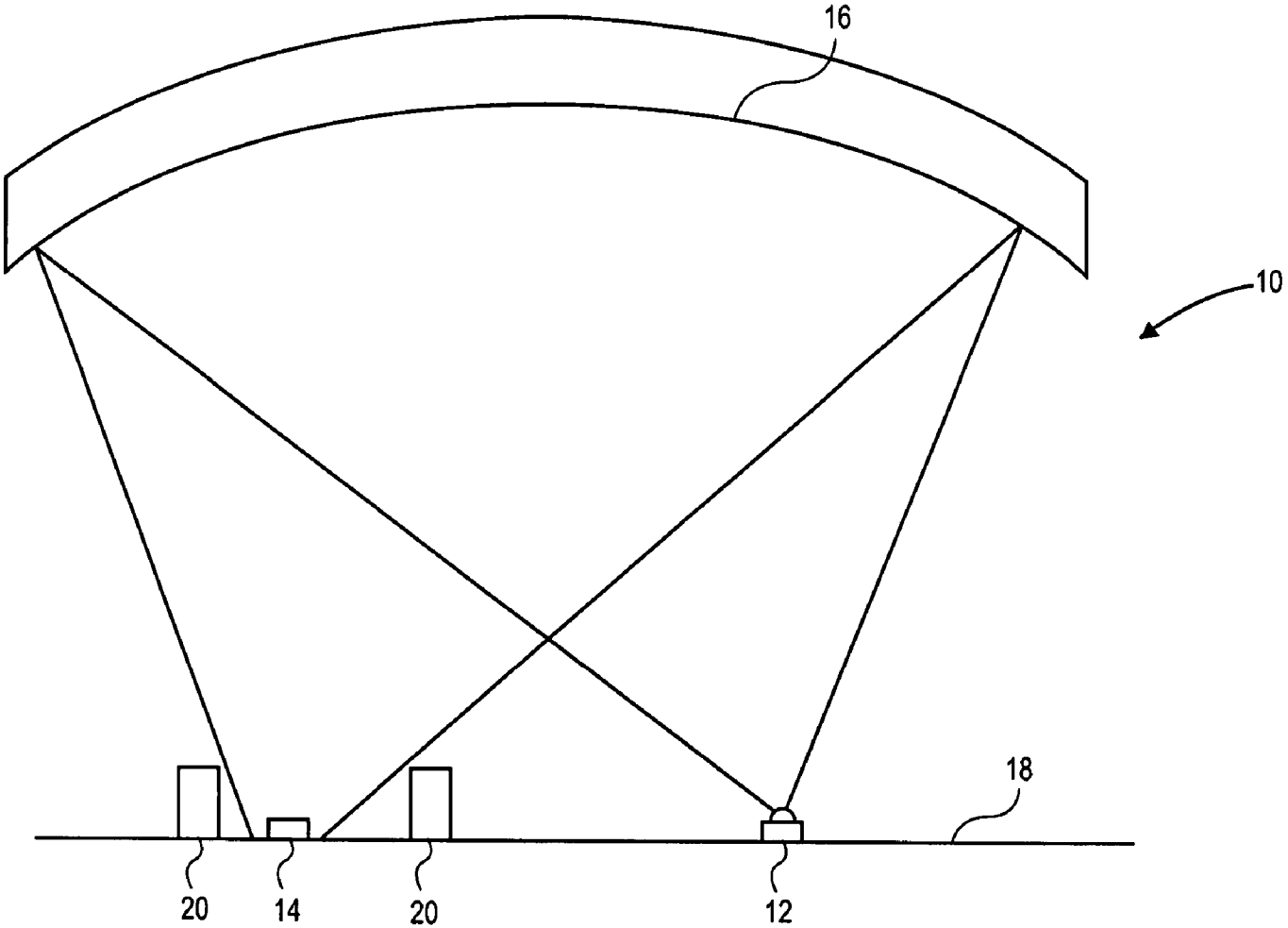
FIG. 1 illustrates a cross-sectional view of a portion of a smoke sensing chamber of a smoke detector according to a first embodiment of the present invention.

Representative embodiments of the present invention will now be described with reference to the drawing figures, in which like reference numerals refer to like parts throughout. Certain embodiments of the present invention are related to smoke detectors. Certain other embodiments of the present invention also provide methods of monitoring smoke concentration.

FIG. 1 illustrates a cross-sectional view of a portion of a smoke sensing chamber 10 of a smoke detector according to a first embodiment of the present invention. The smoke sensing chamber 10 typically has all of the openings leading thereto covered at least by a screen (not illustrated) that prevents bugs from entering the chamber 10. However, the smoke sensing chamber 10 typically does not have any predefined sidewalls other than where the housing of the smoke detector that includes the sensing chamber 10 happen to be positioned.

The smoke sensing chamber 10 includes a light source 12 that, in FIG. 1, takes the form of a Light Emitting Diode (LED). The light source 12 illustrated in FIG. 1 is configured to emit, from a first area thereon, light in a specified wavelength range. According to certain embodiments of the present invention, the specified wavelength range includes the full visible spectrum and/or overlaps at least somewhat with the infrared (IR) and/or ultraviolet (UV) ranges. According to other embodiments of the present invention, the specified wavelength range includes at least one of IR wavelengths and near-IR wavelengths. According to yet other embodiments of the present invention, the specified wavelength range includes UV wavelengths. According to still other embodiments of the present invention, the specified wavelength range includes at least one of blue wavelengths and green wavelengths.

The portion of the smoke sensing chamber 10 illustrated in FIG. 1 also includes a light sensor 14 that is configured to detect the light in the specified wavelength range that is emitted from the light source 12. In FIG. 1, the light sensor 14 takes the form of a photodiode. However, alternate light sensors 12 are also within the scope of the present invention.

Also illustrated in FIG. 1 is a reflective surface 16 that is configured to focus the light in the specified wavelength range onto the light sensor 14 over a second area that is larger than the first area. In FIG. 1, the reflective surface 16 is a mirror. However, other reflective surfaces 16 are also within the scope of the present invention. For example, a reflective coating may be used. Also, a polished plastic surface may be used, particularly if it is desired to minimize the overall cost of the smoke detector. If desired, less reflective surfaces may be used in conjunction with more intense light sources (e.g., LEDs operated at higher current levels) to allow for similar amounts of light to ultimately reach the light sensor 14.

Although alternate configurations are also within the scope of the present invention, the light source 12 and the light sensor 14 illustrated in FIG. 1 are each surface-mounted adjacent to each other on a circuit board 18. Also, a shroud 20 is positioned around the light sensor 14 and at least substantially surrounds the light sensor 14. The shroud 20 is typically opaque at least to the light in the specified wavelength range. As such, the shroud 20 at least substantially prevents light from traveling directly from the light source 12 to the light sensor 14 without reflecting off of the reflective surface 16 and being focused onto the area that includes and surrounds the light sensor 14. In other words, the shroud 20 typically limits the field of view of the light sensor 14 such that the light sensor 14 substantially sees only the reflective surface 16. It should be noted, however, that in order to protect the light sensor 14 from stray light from external light sources, the shroud 20 is typically configured to be opaque to all of the wavelengths of light to which the light sensor 14 is sensitive. In addition, according to certain embodiments of the present invention, the shroud 20 is configured to block light that might reflect around the inside of the detector (e.g., off of the walls of the sensing chamber 10).

The circuit board 18 illustrated in FIG. 1 typically provides one or more electrical connections to each of the light source 12 and the light sensor 14. For example, some connections on the circuit board 18 may be configured to allow power to flow to the light source 12 and/or the light sensor 14 from an exterior power source. Also, connections on the circuit board 18 may be configured to allow electrical signals to travel between the light source 12 and/or the light sensor 14 and one or more controllers, memory storage modules or other electronic components.

When a smoke detector that includes the smoke sensing chamber 10 illustrated in FIG. 1 is in operation, substantially all of the reflective surface 16 has light from the light source 12 incident thereon. Although such substantially complete illumination of the reflective surface 16 is not characteristic of all of the embodiments of the present invention, illuminating a large volume between the light source 12 and the reflective surface increases the sensitivity of the smoke sensing chamber 10 and is often beneficial, as light may then potentially interact with more smoke particles.

Figure 2:
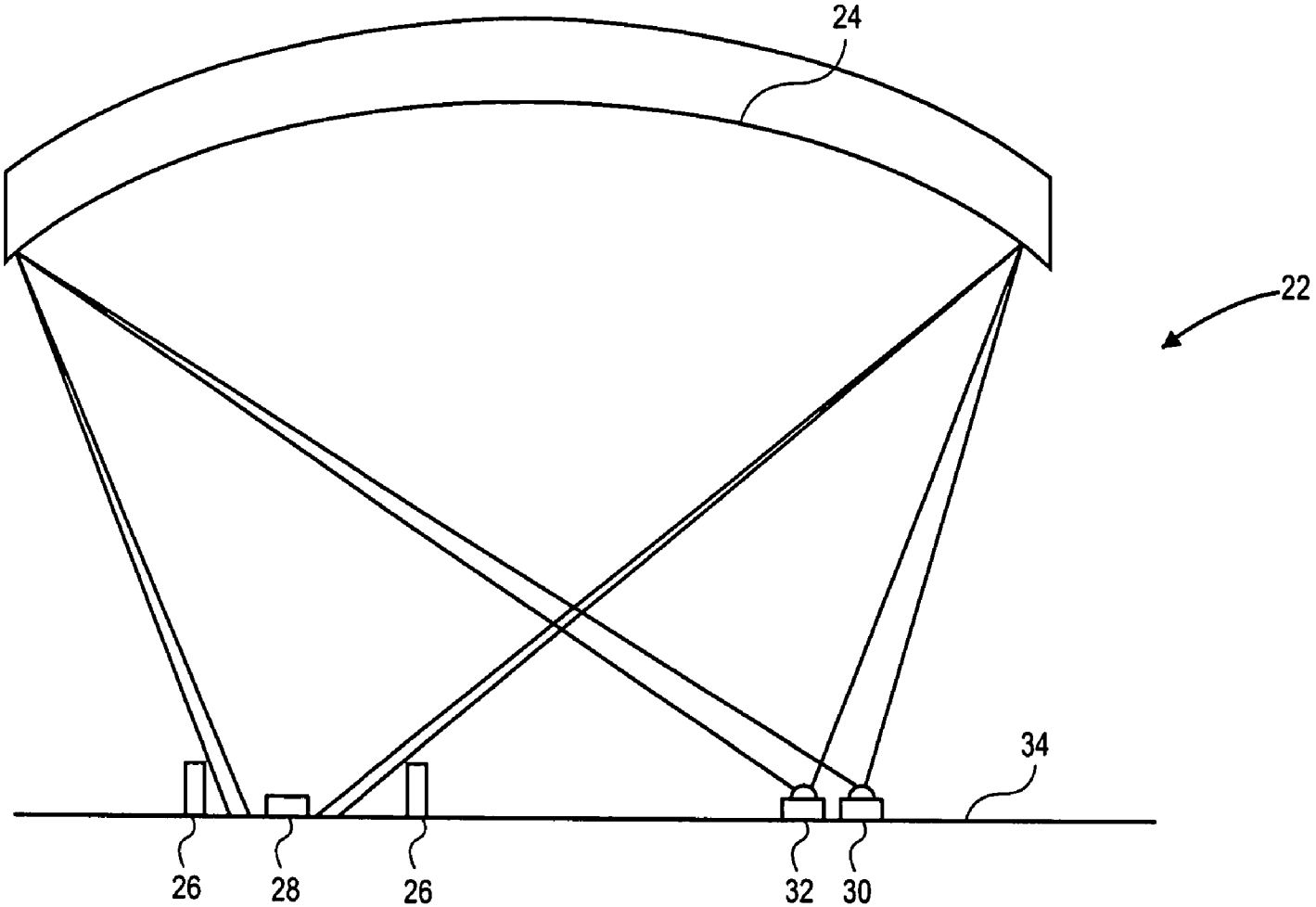
FIG. 2 illustrates a cross-sectional view of a portion of a smoke sensing chamber of a smoke detector according to a second embodiment of the present invention.

FIG. 2 illustrates a cross-sectional view of a portion of a smoke sensing chamber 22 of a smoke detector according to a second embodiment of the present invention. The smoke sensing chamber 22 includes a reflective surface 24, a shroud 26 and a light sensor 28 that are similar to the reflective surface 16, shroud 20 and light sensor 14 illustrated in FIG. 1, respectively.

The smoke sensing chamber 22 illustrated in FIG. 2 also includes a first light source 30 and a second light source, each of which is analogous to the light source 12 illustrated in FIG. 1 at least in the sense that each may emit V, near-UV, visible, near-IR and/or IR light. According to certain embodiments of the present invention, the first light source 30 is configured to emit light in a first wavelength range onto the reflective surface 24 and the second light source 32 is configured to emit light in a second wavelength range onto the reflective surface 24.

Typically, the second wavelength range differs from the first wavelength range. According to certain embodiments of the present invention, the first light source 30 takes the form of an LED that emits IR light and the second light source 32 takes the form of an LED that emits blue light. As will be discussed in greater detail during the discussion of the operation of smoke detectors according to certain embodiments of the present invention, the two light sources 30, 32 emitting light in different wavelength ranges may be used to calculate the sizes of smoke particles in the region between the light sources 30, 32 and the reflective surface 24 and in the region between the reflective surface 24 and the light sensor 28 (i.e., the whole path length of the light from its source 30, 32 to the sensor 28). Also, as will be appreciated by one of skill in the art upon practicing the present invention, a far-IR light may be used for detecting carbon dioxide. However, such detection usually involves the use of a light sensor that is configured to detect far-IR wavelengths.

The shroud 26 illustrated in FIG. 2 is surface-mounted on a circuit board 34. The light sensor 28, which is typically sensitive to light in both the first wavelength range and in the second wavelength range, is surface-mounted on the circuit board 34 on one side of the shroud 26 and each of the light sources 30, 32 is surface-mounted on the circuit board 34 on the other side of the shroud 26. Typically, the shroud 26 is opaque at least to light in the first wavelength range and to light in the second wavelength range. However, the shroud 26 is typically also opaque to all of the wavelengths of light that could be detected by the light sensor 28. Like the circuit board 18 illustrated in FIG. 1, the circuit board 34 illustrated in FIG. 2 typically provides one or more electrical connections to the light sensor 28 and to each of the light sources 30, 32.

Figure 3:
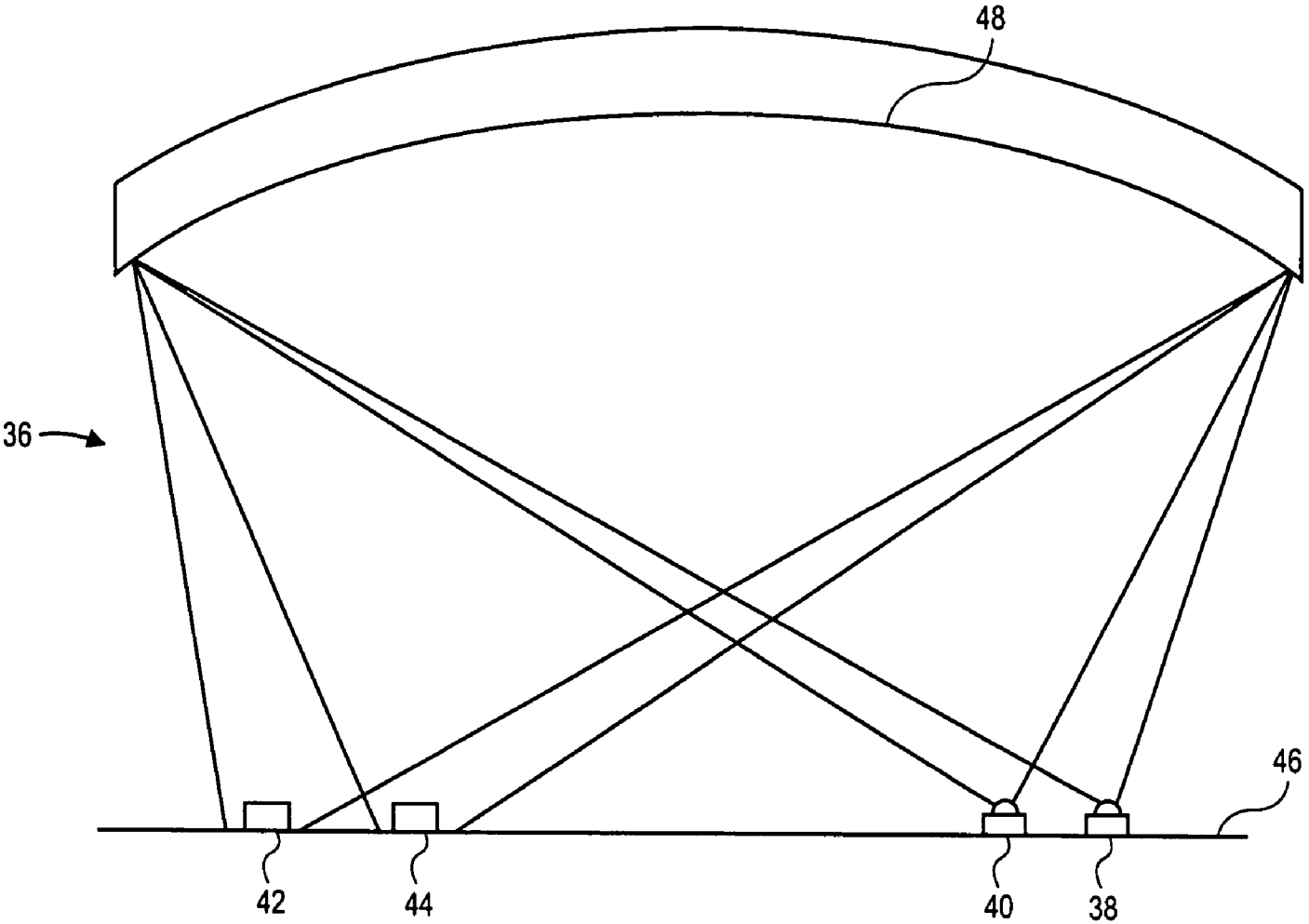
FIG. 3 illustrates a cross-sectional view of a portion of a smoke sensing chamber of a smoke detector according to a third embodiment of the present invention.

FIG. 3 illustrates a cross-sectional view of a portion of a smoke sensing chamber 36 of a smoke detector according to a third embodiment of the present invention. In FIG. 3, a first light source 38, a second light source 40, a first light sensor 42 and a second light sensor 44 are all surface-mounted on a circuit board 46. Positioned directly opposite to the circuit board 46 is a reflective surface 48.

According to certain embodiments of the present invention, the first light source 38 includes an LED that emits light in a first wavelength range (e.g., UV light) and the second light source 40 includes an LED that emits light in a second wavelength range (e.g., IR light). According to some of these embodiments, the first light sensor 42 includes a photodiode that is configured to detect the light in the first wavelength range and the second light sensor 44 includes a photodiode that is configured to detect the light in the second wavelength range.

Although the first light source 38 and the second light source 40 illustrated in FIG. 3 are positioned adjacent to each other, light from the first light source 38 is focused onto the first light sensor 42 and an area surrounding the first light sensor 42 and light from the second light source 40 is focused onto the second light sensor 44 and an area surrounding the second light sensor 44. According to certain embodiments of the present invention, the configuration illustrated in FIG. 3 also includes shrouds that substantially surround one or both of the light sensors 42, 44.

Like the light source 12 in FIG. 1, the first light source 38 illustrated in FIG. 3 emits from an area thereon that is of a relatively small size and the reflective surface 48 focuses the light from the first light source 38 onto an area that is of a relatively large size and that includes the second light detector 44 and that surrounds the second light detector 44. Likewise, the second light source 40 illustrated in FIG. 3 emits from an area thereon that is of a relatively small size and the reflective surface 48 focuses the light from the second light source 40 onto an area that is of a relatively large size and that includes the first light detector 42 and that surrounds the first light detector 42.

Figure 4:
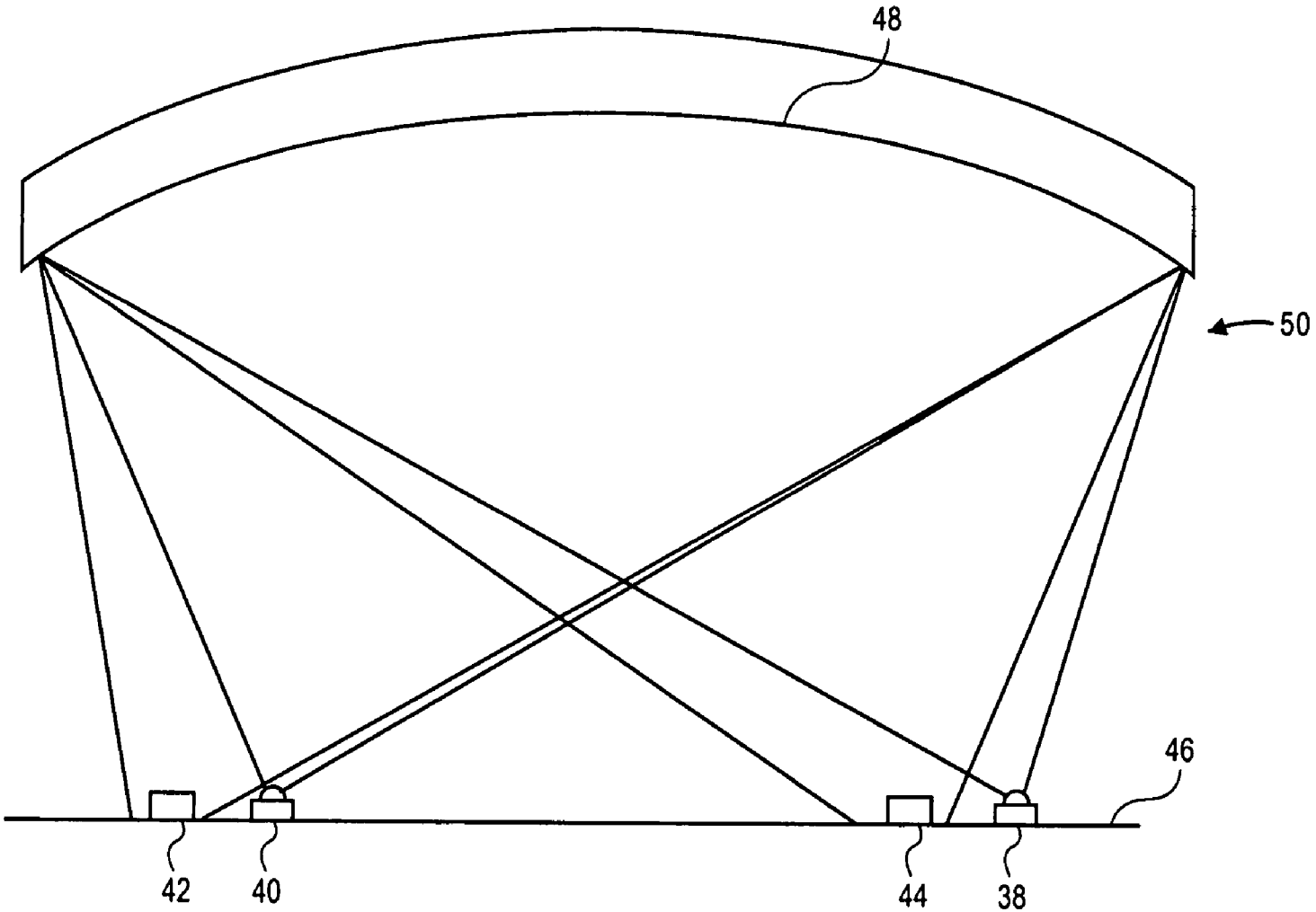
FIG. 4 illustrates a cross-sectional view of a portion of a smoke sensing chamber of a smoke detector according to a fourth embodiment of the present invention.

FIG. 4 illustrates a cross-sectional view of a portion of a smoke sensing chamber 50 of a smoke detector according to a fourth embodiment of the present invention. The smoke sensing chamber 50 illustrated in FIG. 4 is analogous to the smoke sensing chamber 36 illustrated in FIG. 3, with the exception that the positions of the second light source 40 and the second light sensor 44 have been reversed. Since the light sources 38, 40 in the smoke sensing chamber 36 illustrated in FIG. 3 are adjacent to each other, the wiring of the circuit board 46 is typically less complex than the wiring of the circuit board 46 illustrated in FIG. 4. However, the light sources 38, 40 illustrated in FIG. 4 are less likely to have light emitted therefrom being focused onto the wrong light sensor. As such, there is less likely to be interference from the light sources 38, 40 illustrated in FIG. 4.

Figure 5:
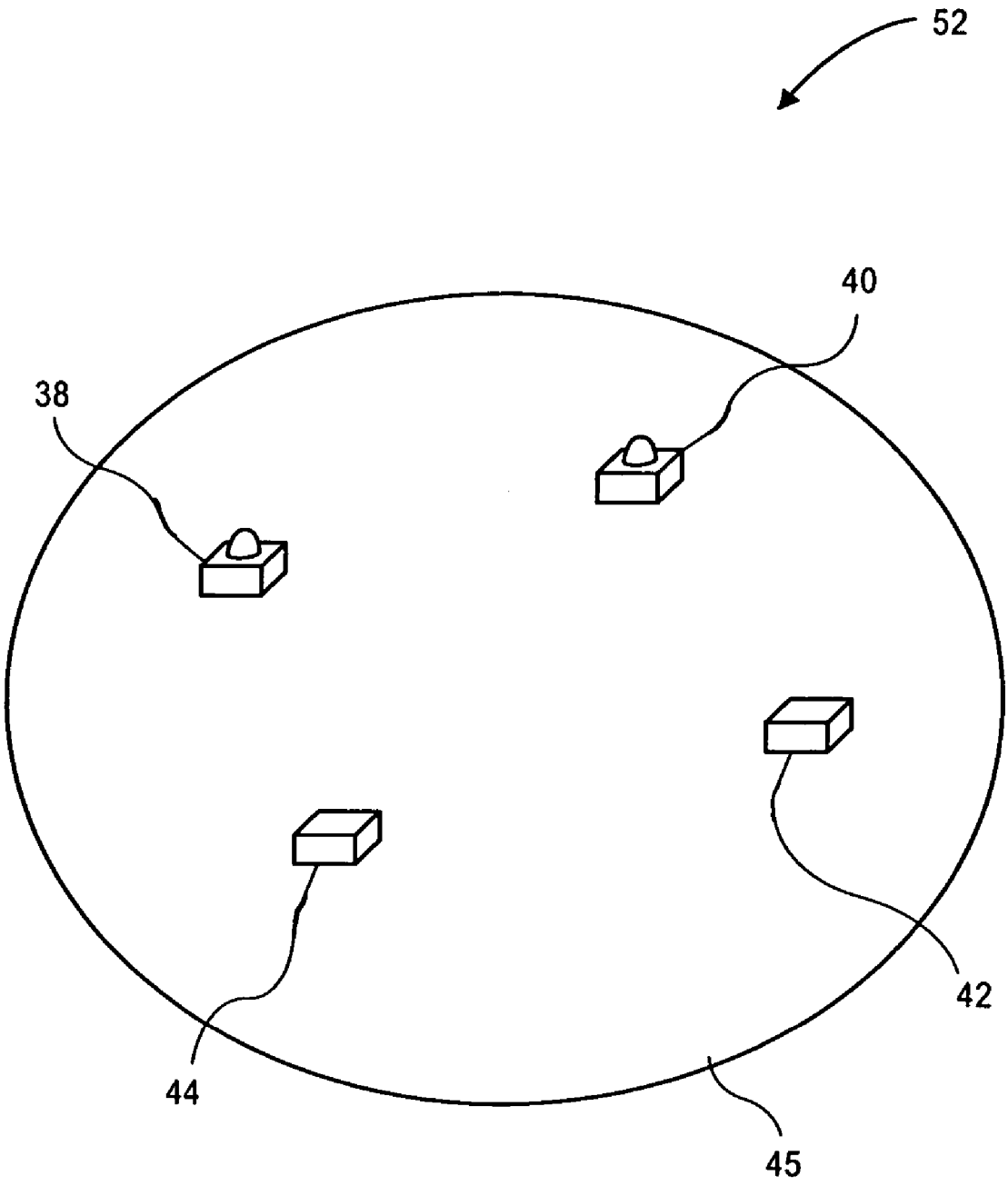
FIG. 5 illustrates a perspective view of a portion of a smoke sensing chamber of a smoke detector according to a fifth embodiment of the present invention.

FIG. 5 illustrates a perspective view of a portion of a smoke sensing chamber 52 of a smoke detector according to a fifth embodiment of the present invention. The smoke sensing chamber 52 illustrated in FIG. 5 includes a first light source 38, a second light source 40, a first light sensor 42 and a second light sensor 44 that are each analogous to light sources and sensors illustrated in FIGS. 3 and 4. Each of the light sources and sensors illustrated in FIG. 5 are surface-mounted to a circuit board 46 that is analogous to the circuit boards illustrated in FIGS. 3 and 4.

A reflective surface is positioned above the circuit board 46 illustrated in FIG. 5. However, for the sake of clarity, this reflective surface is not illustrated. The reflective surface included in the smoke sensing chamber 52 is typically circular and configured to focus light from the first light source 38 onto an area including and surrounding the first light sensor 42 at an angle that is substantially perpendicular to the angle at which it reflects light from the second light source 40 onto the area including and surrounding the second light sensor 44.

Figure 6:
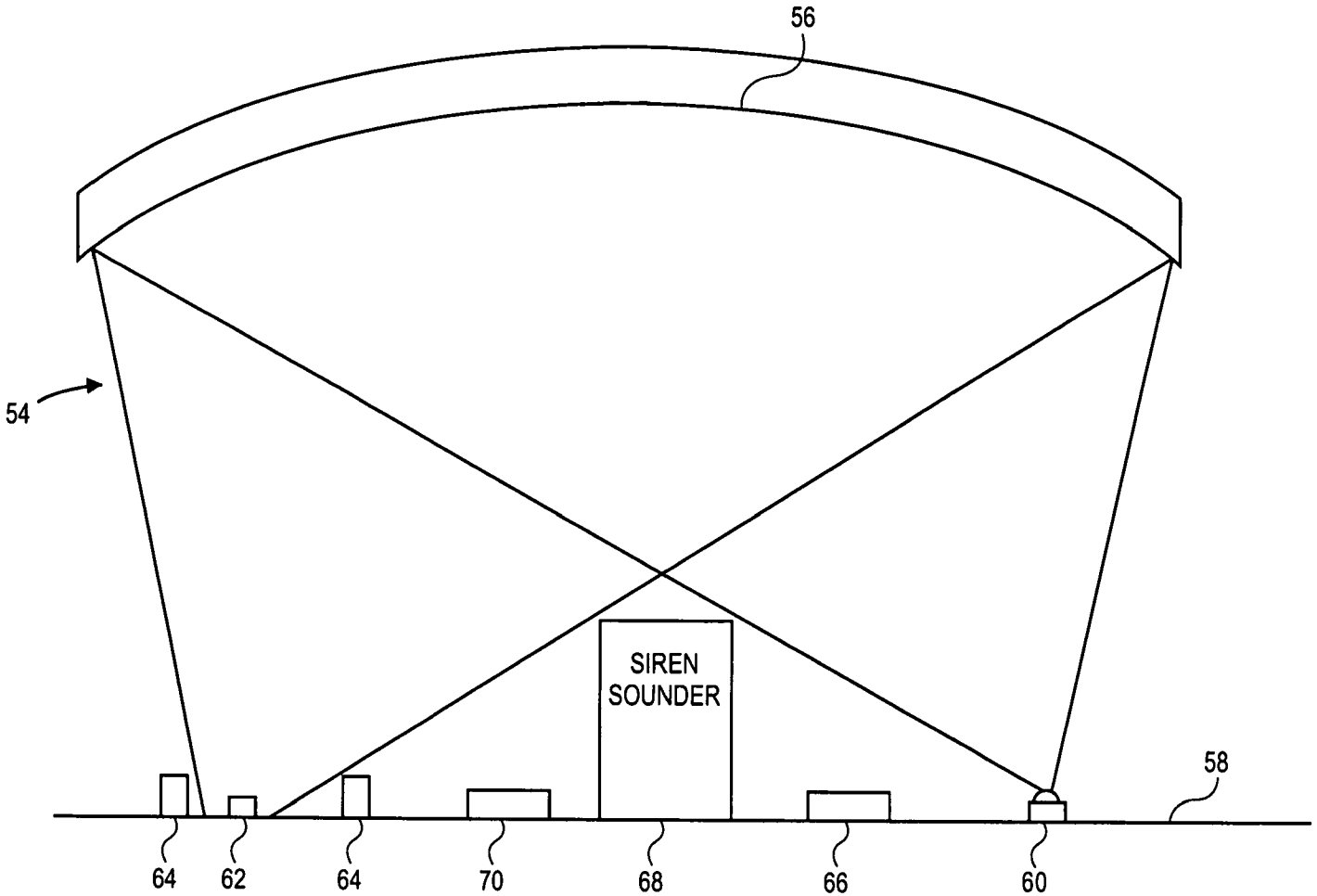
FIG. 6 illustrates a cross-sectional view of a portion of a smoke sensing chamber of a smoke detector according to a sixth embodiment of the present invention.

FIG. 6 illustrates a cross-sectional view of a portion of a smoke sensing chamber 54 of a smoke detector according to a sixth embodiment of the present invention. The smoke sensing chamber 54 includes a reflective surface 56 and a circuit board 58 positioned substantially opposite thereto. Surface-mounted to the circuit board 58 is a light source 60, a light sensor 62 and a shroud 64 that are each analogous to the similarly named items illustrated in FIGS. 1-5.

The shroud 64 substantially surrounds the perimeter of the light sensor 62 and extends perpendicularly in a direction substantially parallel thereto (i.e., perpendicularly to the surface of the circuit board 58 on which the light sensor 62 is mounted). According to certain embodiments of the present invention, the light source 60 is configured to emit light in a specified wavelength range and the shroud 64 is made from a material that is opaque at least to light in the specified wavelength range. However, the shroud 64 is often configured to be opaque to all wavelengths of light that may be detected by light sensor 62. It should also be noted that shrouds of other geometries are also within the scope of the present invention. For example, conically-shaped shrouds may be used.

Typically, the shroud 64 is configured such that it reduces the amount of stray light (e.g., light diffracted by smoke particles in the smoke sensing chamber 54 or reflected off of the walls of the smoke detector in which the smoke sensing chamber 54 is included) that would otherwise become incident upon the light sensor 62. According to certain embodiments of the present invention, the shroud 64 is configured such that it also substantially prevents light from traveling directly from the light source 60 to the light sensor 62 without first reflecting off of the reflective surface 56. Also, according to certain embodiments of the present invention, the shroud 64 is configured to reduce the amount of stray light from external sources that reaches the light sensor 62. Such external sources may include, for example, the sun or ceiling lights that might be mounted close to the smoke detector that includes the smoke sensing chamber 54.

The smoke sensing chamber 54 illustrated in FIG. 6 also includes an electronic component 66 that is surface-mounted on the circuit board 58 and positioned between the light source 60 and the light sensor 62. The electronic component 66, according to certain embodiments of the present invention, includes self-calibration circuitry that is configured to automatically calibrate the smoke detector that includes the smoke sensing chamber 54 during operation thereof. How to implement such self-calibration circuitry will become apparent to one of skill in the art upon practicing the present invention and/or upon reading the discussion of the operation of smoke detectors according to embodiments of the present invention provided below.

Also surface-mounted to the circuit board 58 illustrated in FIG. 6 is a siren sounder 68 and a gas sensor 70. The siren sounder 68, according to certain embodiments of the present invention, is used to alert those in the vicinity of the smoke detector that includes the smoke sensing chamber 54 that a fire has been detected. The siren sounder 68 can protrude far enough from the circuit board 58 that is acts as a light barrier that prevents light from the light source 60 from becoming incident on the light sensor 62 without first reflecting off of the reflective surface 56. However, the siren sounder 68 typically does not protrude so far from the surface of the circuit board 58 that it interferes with light that would otherwise be focused by the reflective surface 56 onto the light sensor 62 and the area surrounding the light sensor 62.

When implementing the gas sensor 64 illustrated in FIG. 6, any gas sensing device may be used. However, according to certain embodiments of the present invention, an absorption sensor configured to detect carbon monoxide is used.

It should be noted that the components illustrated in FIGS. 1-6 are largely interchangeable and, as such, may be included in any of the smoke sensing chambers illustrated therein. It should also be noted that, although, for the sake of clarity, the light sources illustrated in FIGS. 1-6 are only represented as illuminating the surfaces of the reflective surfaces illustrated therein, the light sources typically illuminate a wider volume in the smoke sensing chambers.

Figure 7:
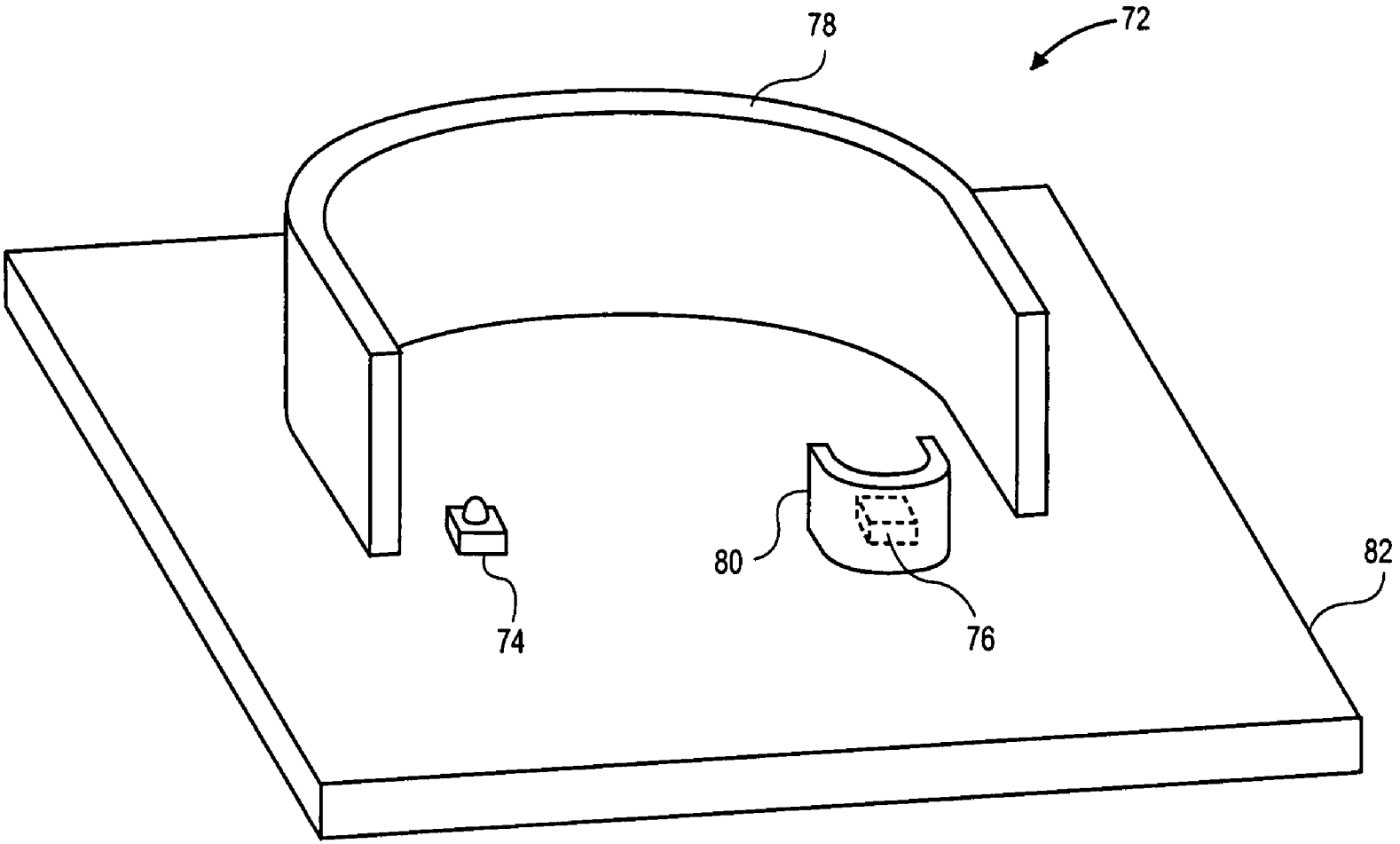
FIG. 7 illustrates a perspective view of a portion of a smoke sensing chamber according to a seventh embodiment of the present invention.

FIG. 7 illustrates a perspective view of a portion of a smoke sensing chamber 72 according to a seventh embodiment of the present invention. Like the smoke sensing chambers illustrated in FIGS. 1-6, the smoke sensing chamber 72 illustrated in FIG. 7 includes a light source 74, a light sensor 76 and a reflective surface 78. The smoke sensing chamber 72 illustrated in FIG. 7 also includes a shroud 80 that is analogous to above-described shrouds at least in the sense that it is opaque at least to wavelengths of light that are emitted by the light source 74 and, in some cases, to all wavelengths of light which the light sensor 76 is configured to detect. Also, the shroud 80 is analogous to above-described shrouds at least in the sense that it reduces the amount of stray light that becomes incident upon the light sensor 76.

The light source 74, the light sensor 76 and the reflective surface 78 illustrated in FIG. 7 are all mounted on the same surface of a circuit board 82. According to other embodiments of the present invention, other components (e.g., gas sensors, electronic components, siren sounders) are also surface-mounted onto the circuit board 82. One major advantage of the configuration illustrated in FIG. 7 is that, once the components illustrated therein are affixed to the circuit board 82, the probability of any of the components becoming misaligned diminished drastically. In other words, it is unlikely that either the light source 74 or the light sensor 76 will move relative to the reflective surface 78 once all of those components are affixed to the same surface.

According to other embodiments of the present invention, methods of monitoring smoke concentration, typically in a specified region, are provided. According to one such method, light in a first wavelength range is emitted from a first area on a first light source. When implemented using, for example, any of the smoke detectors illustrated in FIGS. 1-7, this emitting step may be implemented using any of the above-discussed light sources.

Once the light in the first wavelength range has been emitted, the method includes focusing the light in the first wavelength range onto a second area that is larger than the first area on the first light source. Typically, this second area includes and surrounds a first light sensor. For example, if the light source 12 illustrated in FIG. 1 is an LED that emits UV light from 10 $mm^2$ of it's surface area, the focusing step may be implemented by configuring and using the reflective surface 16 to illuminate a 12 $mm^2$ or 20 $mm^2$ region that includes and surrounds the surface of the light sensor 14. In other words, the reflective surface 16 is generating an image that is slightly "out of focus" onto a region that includes and surrounds the light sensor 14.

Pursuant to the above-listed steps, the method also includes detecting how much of the light in the first wavelength range reaches the first light sensor. When implemented using the smoke detector 10 illustrated in FIG. 1, this detecting step typically includes choosing a photodiode as the light sensor 14 and using the photodiode to detect how much light travels to the reflective surface 16 from the light source 12 and subsequently to the light sensor 14 without getting absorbed, reflected, diffracted or otherwise interacting with particles in the portion of the smoke detector 10 illustrated in FIG. 1.

According to certain embodiments of the present invention, as the concentration of smoke particles between the light source, reflective surface, and light sensor either increases or decreases, the signal intensity from the light sensor fluctuates proportionally to the smoke particle concentration change. Moreover, this proportional fluctuation is irrespective of the color type of the smoke or of how much dust and/or dirt has accumulated in the sensing chamber over time. For example, according to certain embodiments of the present invention, it is desired to detect an amount of smoke in the sensing chamber that obscures 1% of light per foot. If the light travels over a path length of, for example, 2 inches between the light source, reflective surface and light sensor, then the smoke detector must be able to respond to a change of ⅙ of 1% in the amount of light that is detected by the light sensor. Unfortunately, dust and dirt accumulates on the light source, reflective surface, and light sensor over the lifetime of the smoke detector (e.g., 20 years) and decreases the amount of light that can be detected at the light sensor by, for example, as much as 50% or 75%. However, according to some of the embodiments of the present invention discussed below, when an amount of smoke sufficient to obscure 1% of light per foot enters the sensing chamber, the amount of light detected by the light sensor will decrease ⅙ of 1%, regardless of whether or not any dirt or dust has accumulated.

As will be appreciated by those of skill in the art, a shortcoming of scattering-type and ionization-type smoke detectors is that they do not exhibit the above-discussed proportionality. As such, as dirt and dust accumulates in these types of detectors, it is not possible to merely adjust the sensitivity of the detector to compensate for the accumulation. For example, a representative scattering-type detector, when clean, has black surfaces in its sensing chamber to avoid the scattering of light when only clean air is in the chamber. In this detector, after grey dust has accumulated over time to the point where the sensing chamber is completely grey, when grey smoke enters the chamber, the light will not reflect significantly differently if the smoke and the background are of the same color. As such, the sensitivity of the smoke detector cannot be adjusted to compensate for the accumulation. In addition, when black smoke enters the chamber, the light sensor might actually sense a loss of reflected light, which would not look like a fire situation at all. In other words, scattering-type photoelectric detectors can only adjust their sensitivity to compensate over a very limited range and the same is true of ionization-type detectors. In direct contrast, detectors according to the present invention that exhibit the above-discussed proportionality can compensate for dust and dirt accumulation up to the point when the light sensor is no longer able to detect. For example, smoke detectors according to the present invention can include self-diagnostic and self-adjustment capabilities and can be constructed to have an extended, cleaning maintenance-free operational life. In such detectors, as dust or dirt particles build up on the surfaces of the smoke detector, and/or as the optics, light source and/or light sensor slowly degrade over time, drift compensation circuitry is used to compensate. This drift compensation circuitry is typically implemented with a floating background adjustment and, optionally, with synchronous detection, as will be discussed below with reference to FIGS. 8-14.

Returning to a more general discussion of the method of monitoring smoke concentration, it should be noted that the above-discussed emitting step, according to certain embodiments of the present invention, occurs on an intermittent basis. According to these embodiments, the above-mentioned method includes recording a first light intensity value when the first light source is emitting the light in the first wavelength and recording a second light intensity value when the first light source is not emitting the light in the first wavelength. Then, the method includes subtracting the second light intensity value from the first light intensity value to obtain a measured value. By performing these steps, background noise may be significantly reduced.

According to other embodiments of the present invention where the emitting step occurs on an intermittent basis, a first plurality of measurement values is recorded at times when the first light source is emitting the light in the first wavelength. Then, a second plurality of measurement values are recorded at times when the first light source is idle (i.e., not emitting the light in the first wavelength) and the second plurality of measurement values are subtracted from the first plurality of measurement values to obtain a plurality of measured values. Pursuant to this subtraction step, the plurality of measured values are averaged to obtain a single measured value.

The series of steps discussed in the above paragraph effectively reduces the effect of anomalous short-term variations in light intensity readings for the light sensor. For example, if a fluorescent light fixture is positioned close to a smoke detector according to an embodiment of the present invention, the effects on the smoke detector of the light intensity variations that such a fixture experiences as a result of being powered by an AC power source can be eliminated. Also, the effects of radio frequency energy from, for example, cell phones or police walky-talkies operated near a smoke detector according to an embodiment of the present invention can be significantly reduced.

Methods of monitoring smoke concentration according to certain embodiments of the present invention also commonly include emitting light in a second wavelength range from a third area on a second light source and reflecting the light in the second wavelength range onto a fourth area, wherein the fourth area is larger than the third area and typically includes and surrounds the first light sensor. Then, the methods include detecting how much of the light in the second wavelength range reaches the first light sensor. When implemented using the smoke sensing chamber 22 illustrated in FIG. 2, these steps may include, for example, emitting IR light from the surface of an LED used as the first light source 30 and emitting blue light from the surface of an LED used as the second light source 32. Then, both of these wavelength ranges of light are reflected off of the reflective surface 24 and focused onto areas that include and surround the light sensor 28. However, because the light sources 30, 32 illustrated in FIG. 2 are not at the same location, two different areas that include and surround the light sensor 28 are illuminated. Also since, as discussed above, the reflective surface 24 is not configured to be perfectly focused relative to the light sensor 28, when implementing the above steps, the area of that is illuminated by light from the first light source 30 is larger than the area from which the reflected light is emanating from the first light source 30. Likewise, the same concept applies to light from the second light source 32. In addition, when implementing the above steps using the smoke sensing chamber 22 illustrated in FIG. 2, the light sensor 28 is used to detect how much light in each of the two wavelength ranges becomes incident on the surface thereof.

According to certain embodiments of the present invention, the above-discussed method also includes determining the sizes of the particles present in a volume positioned between the mirror and the first light sensor. Then, some of these embodiments include distinguishing between at least two of flaming fires, smoldering fires and/or steam based at least partially on the sizes of the particles determined.

When implementing these embodiments, the smoke sensing chambers illustrated in FIGS. 2-5 may be used, since multiple light sources are included therein. Typically, smoke sensing chambers where these embodiments are implemented also include appropriate control circuitry, examples of which are discussed below.

Certain embodiments of the above-discussed method also include detecting concentration of a gas present in a volume positioned between the mirror and the first light sensor. This detecting step may be implemented, for example, using the gas sensor 70 included in the smoke sensing chamber 54 illustrated in FIG. 6. The gas typically detected during this step is carbon monoxide. However, the detection of other gases is also within the scope of the present invention.

Figure 8:
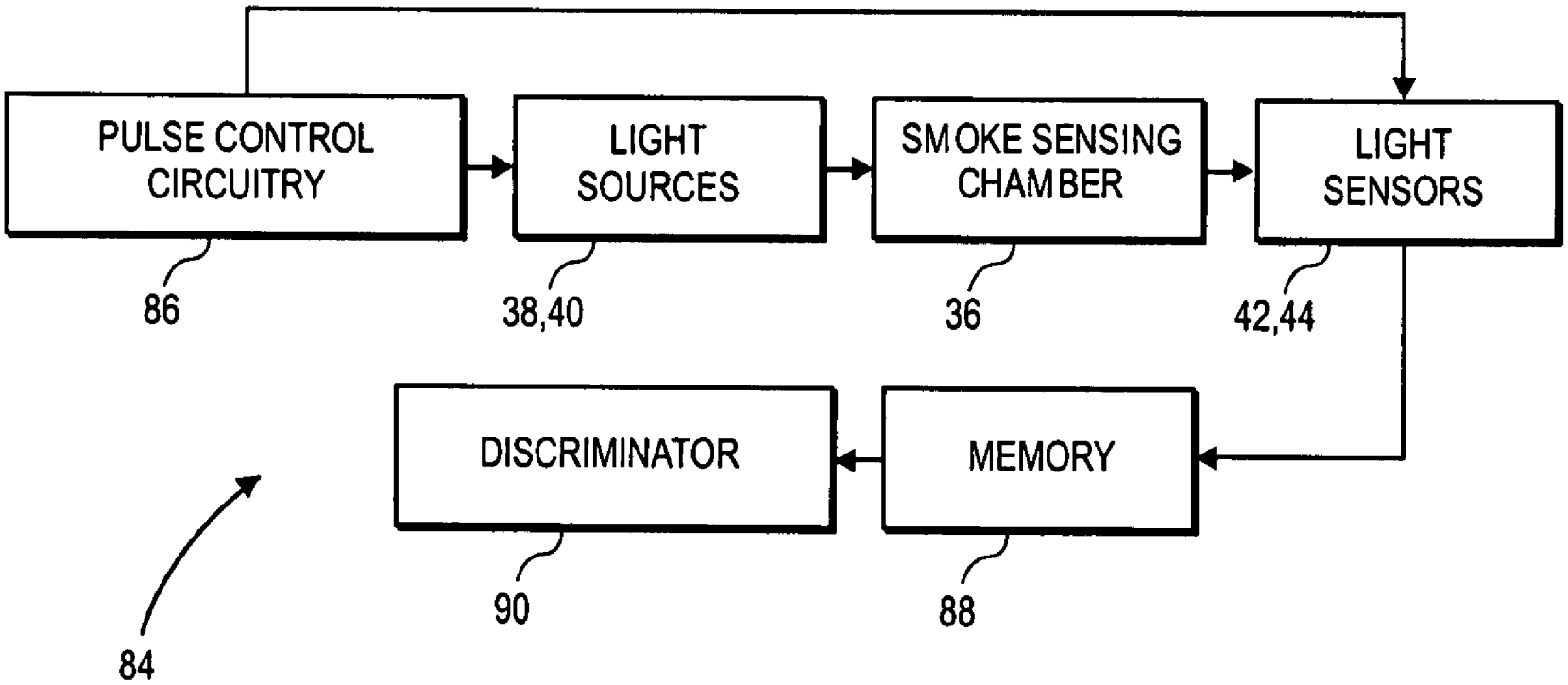
FIG. 8 is a block diagram of smoke sample acquisition control circuitry that may be used to control the operation of one or more light sources and/or light sensors in smoke sensing chambers according to embodiments of the present invention.

FIG. 8 is a block diagram of smoke sample acquisition control circuitry 84 that may be used to control the operation of one or more light sources and/or light sensors in smoke sensing chambers according to embodiments of the present invention. This circuitry 84 may also be used to produce output signals indicative of the size of the smoke particles present in the associated smoke sensing chamber. When used in conjunction with the smoke sensing chamber 36 illustrated in FIG. 3, the pulse control circuitry 86 typically causes alternate light emissions from an infrared light source (e.g., light source 40) and a blue light source (e.g., light source 38). The pulse control circuitry 86 also typically actuates concurrent acquisition/measurement of the corresponding light intensities incident on the light-receiving surfaces of the associated light sensors 42, 44.

Typically, when using the circuitry 84 illustrated in FIG. 8, the measured light intensity values are recorded in one or more memory storage sites 88. The discriminator 90 illustrated in FIG. 8 then receives the acquired and recorded light intensity values of the light beams of different wavelengths and determines from them the average sizes of the gas-borne particles present in the detection chamber. Any of a variety of algorithms known to those of skill in the art may be used to determine these average sizes.

There are four general categories of smoke particle sizes that contribute to the average sizes of smoke particles present in a smoke sensing chamber. The four categories include very small particles (i.e., those produced by fumes, such as cooking or cleaning fluid fumes), smaller particles (i.e., those produced by flaming fire), larger particles (i.e., water vapor and dust particles) and mid-sized particles (i.e., smoldering smoke particles or a mixture of the smaller and larger particles). Therefore, the discriminator 90 is typically configured to distinguish the gas-borne particles from one another by their origins, as indicated by their particle sizes.

One of skill in the art will appreciate that the smoke sample acquisition control circuitry 84 illustrated in FIG. 8 can be modified. For example, the circuitry 84 can be adapted to determine sizes of particles present in smoke detector embodiments that include more than two light sources and/or more than two light sensors.

Figure 9:
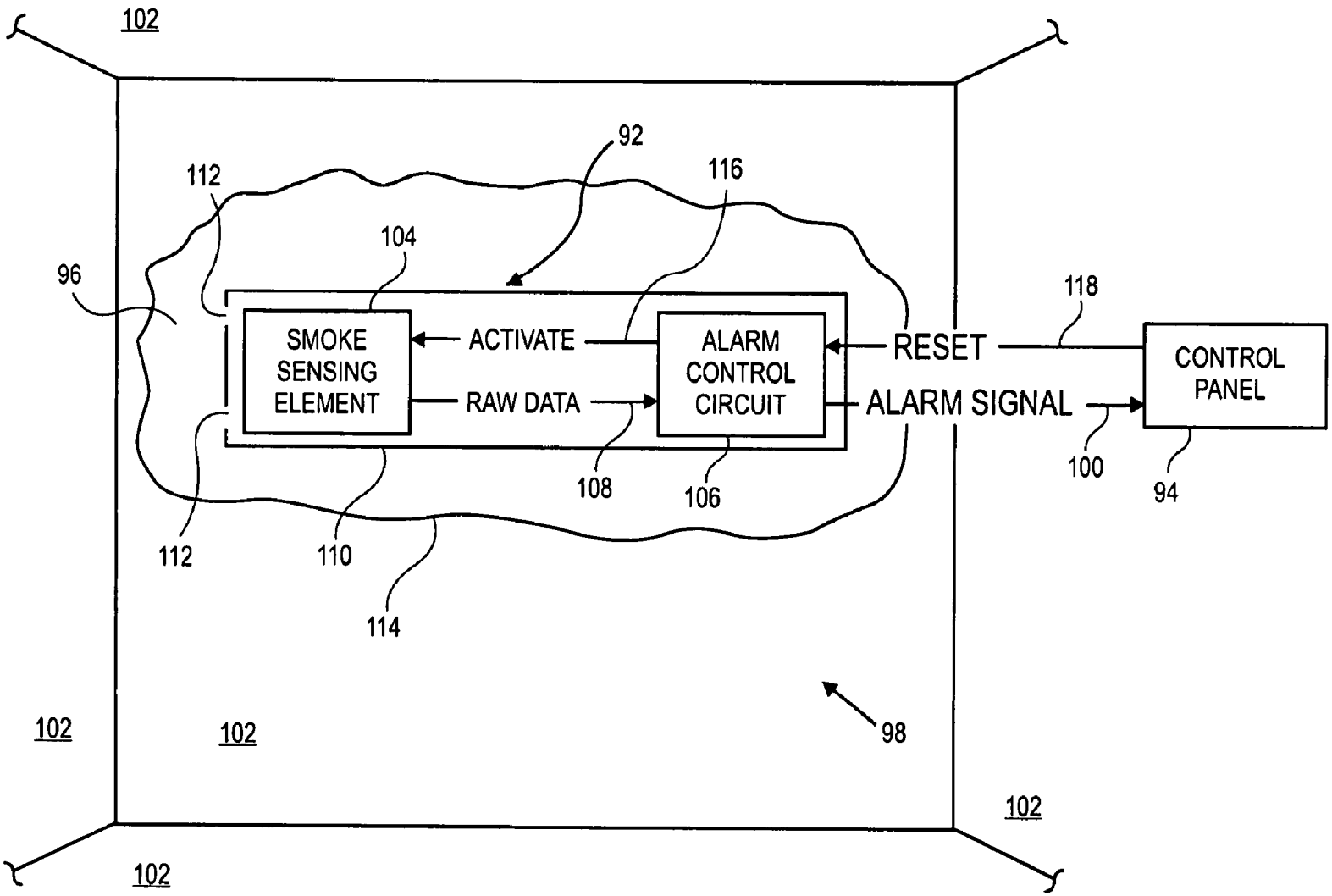
FIG. 9 is a block diagram showing a self-adjusting smoke detector with self-diagnosing capabilities connected to a control panel.

FIG. 9 is a block diagram showing a self-adjusting smoke detector 92 with self-diagnosing capabilities connected to a control panel 94. The smoke detector 92 may include any of the smoke sensing chambers illustrated in FIGS. 1-7 or any other smoke sensing chamber that will become apparent to one of skill in the art upon practicing the present invention.

The self-contained smoke detector 92 illustrated in FIG. 9 may be used to determine whether, at a spot 96 in a confined spatial region 98 being monitored, there is a sufficiently high concentration of smoke particles that an alarm condition should be signaled. If the concentration of smoke particles (i.e., the level of smoke) is sufficiently high, the smoke detector 92 transmits an alarm signal over a signal path 100 to the control panel 94.

The representative spatial region 98 illustrated in FIG. 9 is at least partly confined by the surfaces 102 illustrated in FIG. 9. Also, the smoke detector 92 includes a smoke sensing element 104 that measures the smoke level at the spot 96. The smoke sensing element 104 typically includes at least one light source, one light sensor and a reflective surface. The smoke sensing element 104 then provides a sensing element signal and/or raw data (i.e., data that have not yet been manipulated in the manner described below) indicative of the smoke level at the spot 96 to an alarm control circuit 106 over the signal path 108.

The smoke sensing element 104 and the alarm control circuit 106 illustrated in FIG. 9 are each mounted on a discrete housing 110 that operatively couples the smoke sensing element 104 to the region 98. The discrete housing 110 also mounts the smoke sensing element 104 and the alarm control circuit 106 at the spot 96. However, other configurations of smoke detectors are also within the scope of the present invention.

The housing 110 may, but need not, incorporate a replaceable canopy. Also, the housing 110 illustrated in FIG. 9 may have one or more openings 112 that admit ambient air 114, along with any associated smoke, for measurement by the smoke sensing element 104.

The alarm control circuit 106 illustrated in FIG. 9 controls the activation of the smoke sensing element 104 over the signal path 116. The control panel 94 resets the alarm control circuit 106 over the signal path 118. According to certain embodiments of the present invention, the alarm control circuit 106 is located in the control panel 94. In other words, the alarm control circuit 106 need not be located in the region 98. Also, it should be noted that, according to certain embodiments of the present invention, an analog smoke detector sends an A/D sensing level back to the control panel 94 and all decisions are made within the control panel 94. On the other hand, in some embodiments, all of the control panel functions are performed in the smoke detector, particularly in self-contained smoke alarms such as those used in many residential applications.

Figure 10:
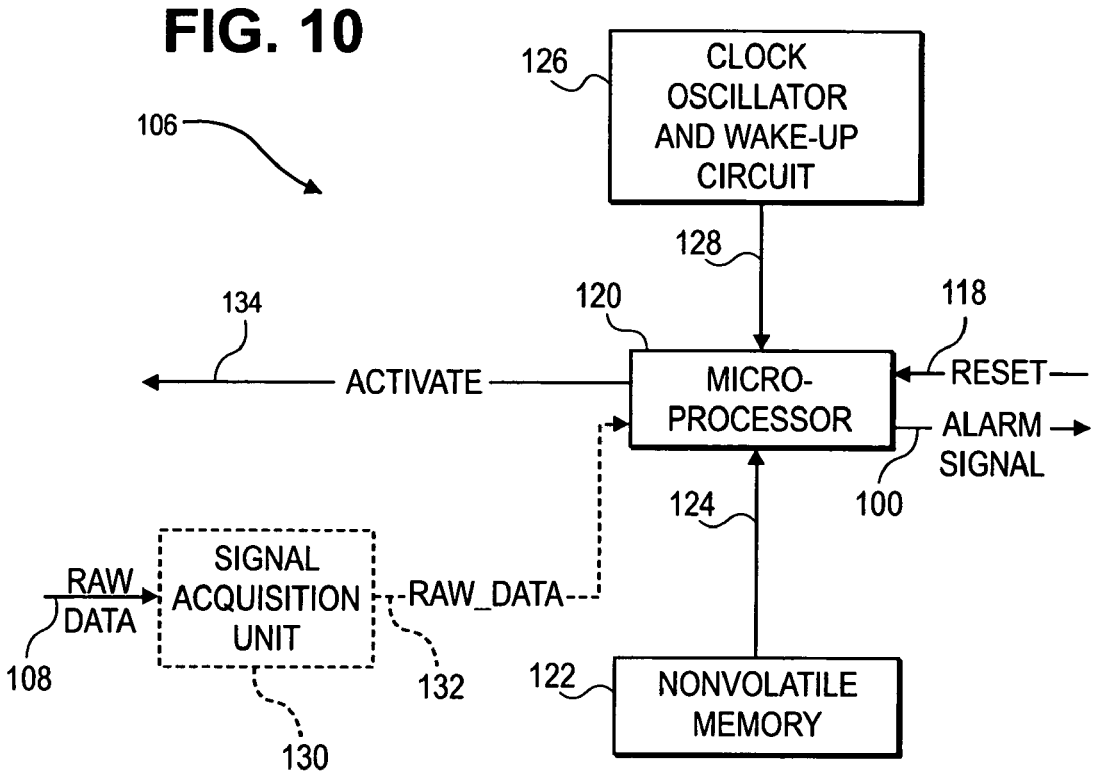
FIG. 10 is a schematic block diagram of the alarm control circuit illustrated in FIG. 9.

FIG. 10 is a schematic block diagram of the alarm control circuit 106 illustrated in FIG. 9. As illustrated in FIG. 10, the alarm control circuit 106 includes a microprocessor 120 and a nonvolatile memory 122 (e.g., an electrically erasable programmable read-only memory) connected to the microprocessor 120 over a signal path 124. A clock oscillator and wake-up circuit 126 is also connected to the microprocessor 120 over a signal path 128 and an instruction set for the microprocessor 120 is typically contained in read-only memory that is internal to the microprocessor 120. The nonvolatile memory 122 commonly holds certain operating parameters, such as those described below, that are determined during calibration of the circuit 106.

When sent to the alarm control circuit 106, raw data from the smoke sensing element 194 illustrated in FIG. 9 may lead to the emission of an optional signal to the acquisition unit 130 over the signal path 108. The acquisition unit 130 typically converts or conditions the raw data which are, for example, analog data, into a digital form (i.e., RAW_DATA). Then the acquisition unit 130 typically conveys that digital form over a signal path 132 to the microprocessor 120.

The signal acquisition unit 130 commonly includes an analog-to-digital (A/D) converter, an example of which is described below with reference to FIGS. 13 and 14. The A/D converter is typically used to convert the analog output of a light sensor to digital form. If the smoke sensing element 104 illustrated in FIG. 9 produces its raw data output in a form, whether analog or digital, that the microprocessor 120 can receive directly, then the signal path 108 conveys that raw data directly to the microprocessor 120. The microprocessor 120 then produces from that raw data the digital representation RAW_DATA on which it operates.

To reduce the power requirements of the smoke detector 92 illustrated in FIG. 9, according to certain embodiments of the present invention, the microprocessor 120 remains inactive or "asleep" except when it is periodically "awakened" by the clock oscillator and wake-up circuit 126 which, depending on the microprocessor 120 selected, may be internal or external thereto. To further reduce power requirements, the microprocessor 120 may be configured to activate the smoke sensing element 104 over the signal path 134 to sample the smoke level in the region 98 illustrated in FIG. 9. Any form of sampling that produces samples of the output of the smoke sensing element 104 at appropriate times is within the scope of the present invention. The sampling typically produces successive samples, each indicative of a smoke level at a respective one of successive sampling times. As illustrated in FIG. 9, the microprocessor 120 may be reset over the signal path 118 by the control panel 94.

Figure 11:
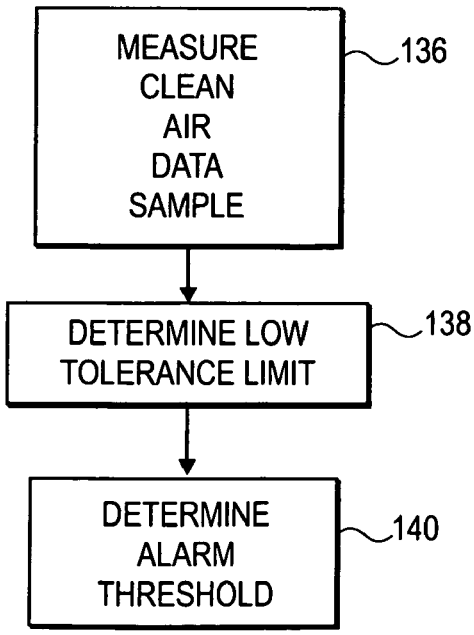
FIG. 11 is a flow diagram showing a series of calibration steps that are performed during calibration of the smoke detector illustrated in FIG. 9 according to an embodiment of the present invention.

The self-adjustment and self-diagnostic capabilities of the smoke detector 92 illustrated in FIG. 9 typically depend upon calibrating the sensor electronics and storing certain parameters in the nonvolatile memory 122. FIG. 11 is a flow diagram showing a series of calibration steps that are performed during calibration of the smoke detector 92 illustrated in FIG. 9 according to an embodiment of the present invention. These steps are typically performed in the factory where the smoke detector 92 is manufactured.

The first process block 136 illustrated in FIG. 11 specifies measuring, in an environment known to be free of smoke, a clean air signal or clean air data sample CLEAN_AIR that represents a substantially 0% smoke level. Usually, the clean air voltage of the photodiode operational amplifier that may be included in the smoke detector 92 is a relatively high voltage. The second process block 138 in FIG. 11 then specifies determining a low tolerance limit, which is generally used in self-diagnosis and is typically set well below CLEAN_AIR.

The third process block 140 specifies determining an alarm threshold that corresponds to an output of the smoke sensing element 104 which indicates the presence of excessive smoke in the region 98 and in response to which an alarm condition should be signaled. This process block 140 is particularly relevant to embodiments of the present invention where the above-discussed method of monitoring smoke concentration includes collecting a first smoke concentration value at a first time and a second smoke concentration value at a second time and then setting off an alarm when the first smoke concentration value differs from the second smoke concentration by at least a predetermined threshold value. According to certain of these embodiments, the alarm threshold is set as a percentage value of CLEAN_AIR. The ability to set the alarm threshold without the use of a simulated smoke environment representing a calibrated level of smoke is an advantage over prior art light scattering systems.

Upon conclusion of the calibration process, the output of the smoke sensing element 104 and the signal acquisition unit 130, if used, is calibrated. Also, values for CLEAN_AIR, the low tolerance limit and the alarm threshold are stored in the memory 122. The first two of those values are specific to the individual smoke detector 92 that was calibrated and the third value (i.e., the alarm threshold) is usually a simple factor of CLEAN_AIR. Also commonly stored in the memory 122 are values for a slew limit and ADJISENS, the use of which is described below.

Figure 12:
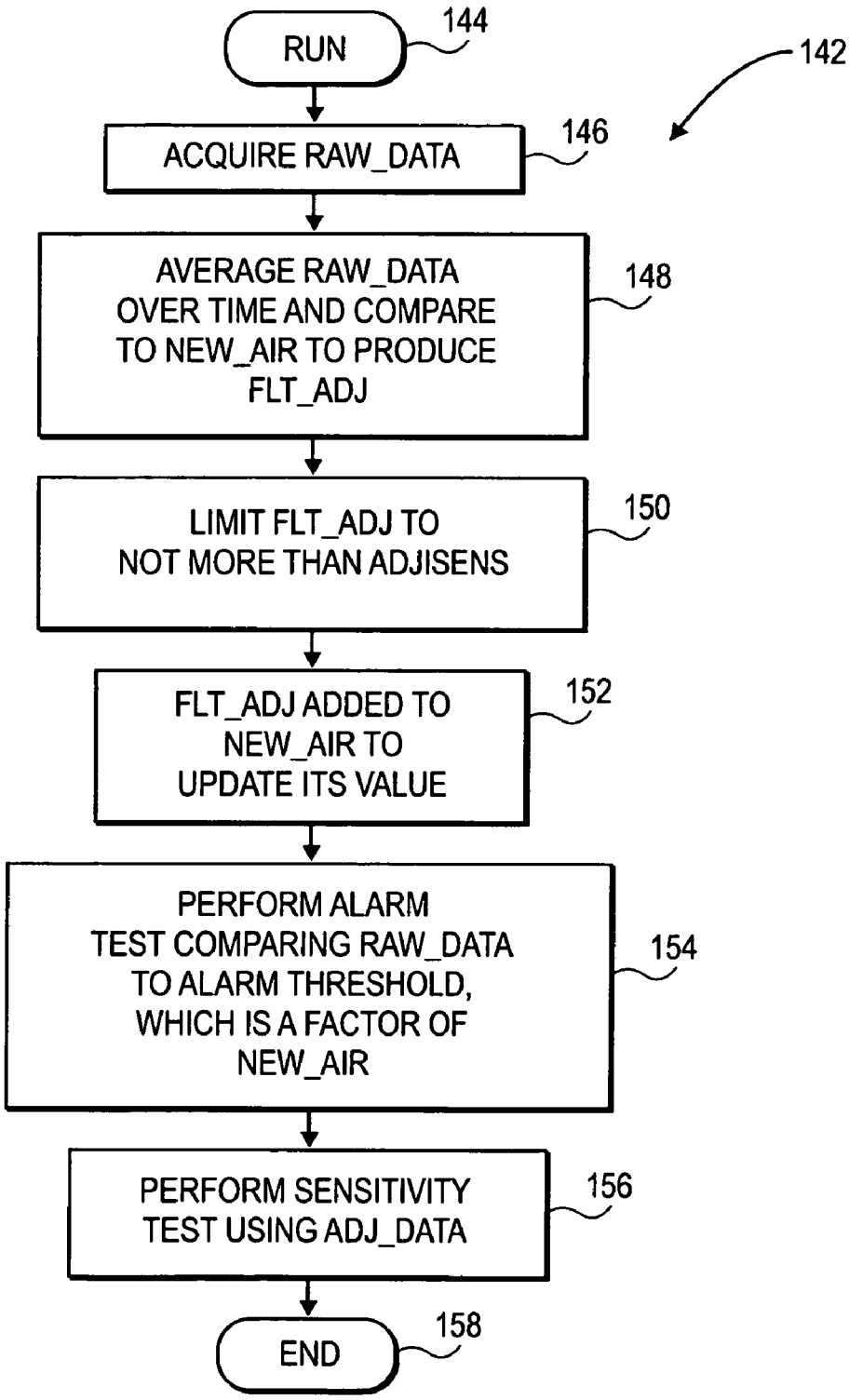
FIG. 12 is a flow diagram summarizing representative steps that may be executed by the microprocessor shown in FIG. 10 in performing self-adjustment, determining whether an alarm condition exists and carrying out self-diagnosis.

FIG. 12 is a flow diagram summarizing representative steps that may be executed by the microprocessor 120 shown in FIG. 10 in performing self-adjustment, determining whether an alarm condition exists and carrying out self-diagnosis. The self-adjustment and self-diagnostic features of certain embodiments of the present invention, as implemented in the algorithm described in connection with FIG. 12, are premised on the assumption that there is a constant ratio between the measured percent of light obscuration at the output of the smoke sensing element 104 and the level of smoke. That relationship can be expressed as:

$$O=r*S,$$

where O represents the measured percent of light obscuration, r represents a fixed ratio that is a result of the path length and wavelength of the light beam and S represents the actual level expressed as percent-per-foot obscuration of smoke present in the chamber.

The measured percent obscuration is determined by the following formula:

$$O=1-M/NA,$$

where O is as defined above, M represents the measured output of the smoke sensing element 104 when smoke is present and NA represents the measured output of the smoke sensing element 104 when clean air is present at the time of the measurement. The equation is unaffected by a build-up of dust or other contaminants.

As dust, contamination, degradation of the light source and/or a change in sensor sensitivity over time (i.e., over days, weeks, months or even years) causes a reduction of measured signal output in clean air, the measured signal output when smoke is present will also be reduced by the same factor. Therefore, according to certain embodiments of the present invention, signal loss due to, for example, any of the above-listed factors, is automatically compensated for in the methods of monitoring smoke concentration. Also, according to certain embodiments of the present invention, the methods of monitoring smoke concentration include automatically compensating for changes in the sensitivity of a light sensor over time. These embodiments can, for example, automatically compensate for changes in sensitivity of any of the light sensors illustrated in FIGS. 1-7.

Contamination may occur in any of the sensing chambers illustrated in FIGS. 1-7 and/or degradation of any of the components included therein may also occur over time. This causes the smoke sensing element 104 illustrated in FIG. 9 to produce, under conditions in which smoke indicative of an alarm condition is not present (NA), an output different from CLEAN_AIR. According to certain embodiments of the present invention, whenever the output of the smoke sensing element 104 under such conditions falls below the clean air voltage measured at calibration, the smoke detector 92 becomes more sensitive in that it will produce an alarm signal when the smoke level falls below the level to which the alarm threshold was set. This can cause unnecessary production of the alarm signal, which is solved by the self-adjustment procedure discussed below.

There is, even with changes over time, a direct correlation between a change in output voltage for NA and a change in output voltage for M. Therefore, certain embodiments of the present invention exploit that correlation by using certain changes over time in the output of the smoke sensing element 104 as a basis for adjusting for changes of CLEAN_AIR to maintain the smoke detector 92 with the sensitivity with which it was calibrated.

The self-adjustment process that the microprocessor 120 executes according to certain embodiments of the present invention is designed to correct, within certain limits, for changes in the sensitivity of the smoke detector 92 while retaining the effectiveness of the smoke detector 92 for detecting fires. The self-adjustment process rests on the fact that a change in the output of the smoke sensing element 104 over a data gathering time interval that is long in comparison to the smoldering time of a slow fire in the region 98 usually results from a change in sensitivity of the system and not from a fire.

The microprocessor 120 illustrated in FIG. 10 uses such a change as a basis for determining a floating adjustment FLT_ADJ that is used to adjust the original recorded CLEAN_AIR level to create a NEW_AIR level. The NEW_AIR level then functions as a close approximation of NA. ADJ_DATA, which is the total difference between CLEAN_AIR and NEW_AIR, is then also used for self-diagnosis.

The flow diagram in FIG. 12 shows an algorithm or routine 142 that may be implemented in the microprocessor 120 to carry out the self-adjustment, alarm test and self-diagnosis features of certain embodiments of the present invention. According to the routine 142, the microprocessor 120 receives successive signal samples produced by the smoke sensing element 104 and uses those samples for at least the three purposes discussed below.

First, the microprocessor 120 determines successive floating adjustments or values of FLT_ADJ. These determinations, as indicated in process blocks 146 and 148, make use of the sensing element signal or RAW_DATA produced during a corresponding one of successive data gathering time intervals or 24-hour periods. Each data gathering time interval extends a data gathering duration or 24 hours. Each floating adjustment is indicative at least in part of relationships between RAW_DATA in the data gathering duration or 24-hour period and NEW_AIR.

The value of FLT_ADJ, or at least the trend from one value of FLT_ADJ to the next succeeding value, is generally indicative of whether RAW_DATA is lower than NEW_AIR in the corresponding data gathering duration or 24-hour period. According to certain embodiments of the present invention, FLT_ADJ is (after initialization) updated once every 24 hours on the basis of selected samples produced in those 24 hours.

Second, as indicated in the process blocks 148, 152 and 154, the microprocessor 120 determines, at successive smoke level determination times, whether the output of the sensing element 104 or RAW_DATA indicates an excessive level of smoke at the spot 96 in the region 98. The microprocessor 120 does so using an alarm threshold that is set as a factor of NEW_AIR, the sensing element signal and one of the NEW_AIR floating adjustments that corresponds to the smoke level determination time.

The corresponding one of the floating adjustments used has as its data gathering time interval an interval that is recent. More specifically, the time interval is typically sufficiently recent to the smoke level determination time that the sensing element signal, in the absence of smoke, is unlikely to have changed significantly from the data gathering time interval to that smoke level determination time. In certain embodiments of the present invention, the value of FLT_ADJ is used immediately after the 24-hour period, which is the typical data gathering time interval for that value of FLT_ADJ. During such a 24-hour time span, it is unlikely that the response of the sensing element 104 in the absence of smoke would change significantly in the region 98.

At least in principle, a value of FLT_ADJ that was produced on the basis of a data gathering time interval much more than 24 hours before (even a year before) that value of FLT_ADJ is used at a smoke level determination time could produce acceptable results for some regions 98. However, whether a data gathering time interval is sufficiently recent to a smoke level determination time for a floating adjustment determined on the basis of that data gathering time interval to be used at that smoke level determination time depends upon several factors. For example, it depends upon the rapidity of significant change in the sensing element signal in the absence of smoke and the desired degree of fidelity of FLT_ADJ at that smoke level determination time.

Third, the microprocessor 120 determines, based on a determination of an excessive level of smoke, whether to signal the existence of an alarm condition by activating its alarm signal over the signal path 100. Typically, the microprocessor 120 activates its alarm signal only when it has determined that RAW_DATA exceeds the alarm threshold for a predetermined time or for a predetermined number of or three consecutive signal samples.

The above-described confirmation of an alarm condition provides a major advantage over conventional smoke detectors and smoke detector systems. Although a smoke detector is generally designed to respond promptly, every false alarm places firefighters' lives at risk while they are traveling to the scene of the false alarm, decreases firefighters' ability to respond to genuine alarms and imposes unnecessary costs. Therefore, the choice of the predetermined time or of the predetermined number of consecutive signal samples according to certain embodiments of the present invention entails balancing the need for prompt signaling of a true alarm condition against the need to avoid false alarms.

With reference to FIG. 12, according to certain embodiments of the present invention, the microprocessor 120 executes the routine 142 once every 9 seconds or so, entering those steps at the RUN block 144. However, according to some of these embodiments, at power-up or reset, the microprocessor 120 executes the routine 142 approximately once every 1.5 seconds for the first four executions.

The two process blocks 148, 150 indicate processes that the microprocessor 120 generally performs only at selected times. To conserve code in a practical implementation, conditions controlling entry into the process block 148 may be tested even in executions of the routine 142 in which such processes are not to be carried out. The process block 150 may be carried out in each execution of the routine 142, even though it has the potential to affect the value of FLT_ADJ only in executions in which FLT_ADJ is changed.

The process block 150 specifies that the microprocessor 120 then limits the maximum value of FLT_ADJ to not more than a predetermined low limit ADJISENS. According to certain embodiments of the present invention, ADJISENS limits the extent to which the smoke detector 92 will self-correct for insensitivity. ADJISENS is typically chosen in conjunction with the tolerance limits so that slow, smoldering fires will not adjust NEW_AIR sufficiently to alter the actual clean air reference so that the smoke detector 92 is still operable to detect fires reliably. ADJISENS typically corresponds to a change in smoke obscuration level of about 0.1%/ft (or smaller) in the digital word FLT_ADJ. Generally, ADJISENS is set so that the smoke detector 92 does not automatically produce an alarm signal at power-up or reset in the initialization process described below.

As indicated by the process block 154, the microprocessor 120 then performs an alarm test comparing RAW_DATA with the alarm threshold value established during calibration as a preset factor of NEW_AIR and stored in the memory 122. The microprocessor 120 also activates the alarm signal when RAW_DATA equals or is less than the alarm threshold value for three consecutive signal samples, or as described above. Then, as indicated by the process block 156, the microprocessor 120 uses ADJ_DATA to perform a self-diagnostic sensitivity test to determine whether to signal that the smoke detector 92 is sufficiently out of adjustment to require service. When that task is complete, the microprocessor 120 ends that execution of the routine 142, as indicated by the END block 158.

Figure 13:
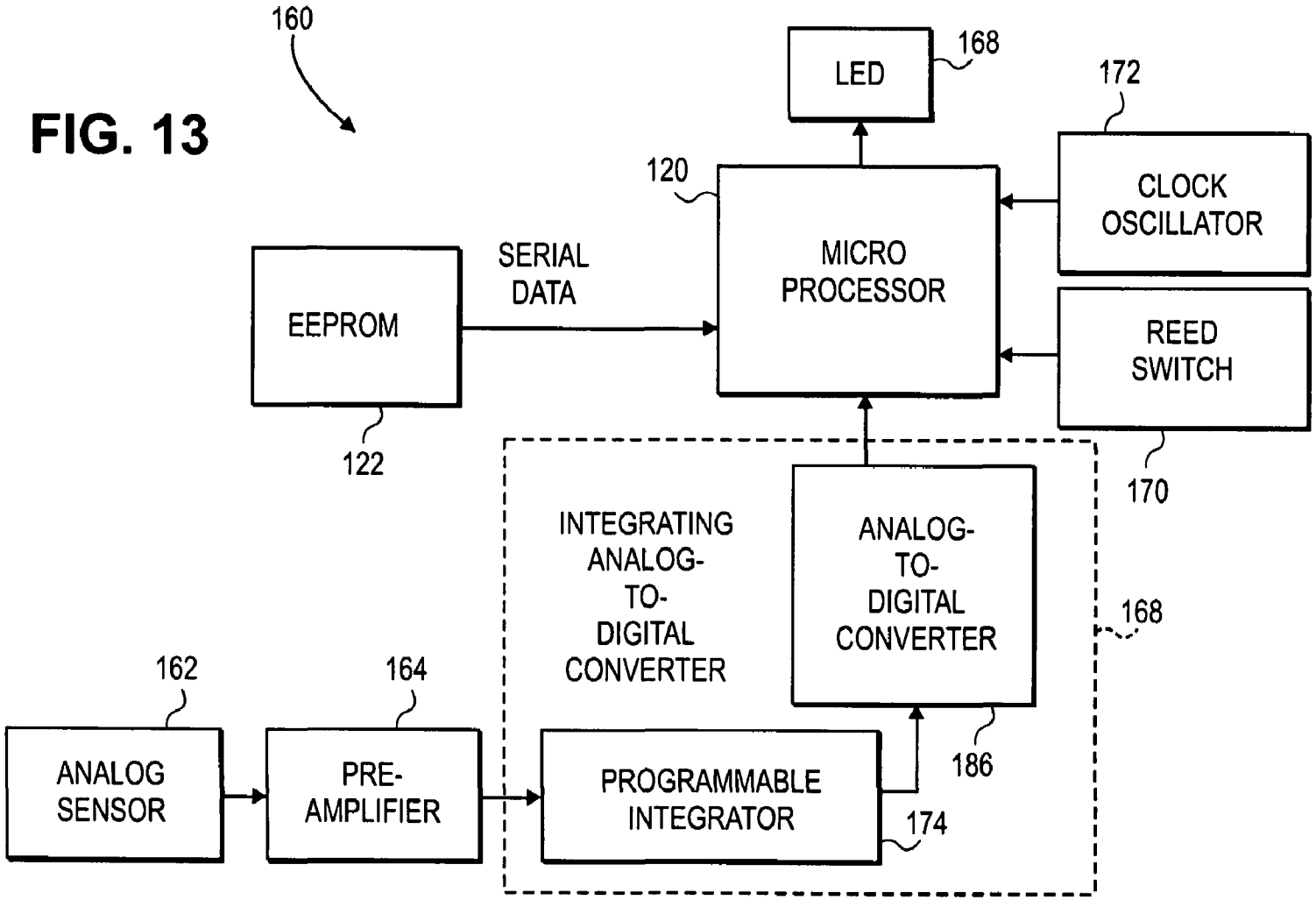
FIG. 13 is a general block diagram of a representative microprocessor-based circuit that implements the self-diagnostic and calibration functions of the smoke detector of FIG. 9.

FIG. 13 is a general block diagram of a representative microprocessor-based circuit 160 that implements the self-diagnostic and calibration functions of the smoke detector of FIG. 9. The operation of the circuit 160 may be controlled, for example, by the microprocessor 120 illustrated in FIG. 10, that periodically applies electrical power to a photodiode (or other light sensor) which is a part of the smoke sensing element 104 to sample the amount of smoke present in a smoke sensing chamber such as, for example, any of the smoke sensing chambers illustrated in FIGS. 1-7.

Periodic sampling of the output voltages of light sensors or photodiodes) such as, for example, the light sensors illustrated in FIGS. 1-7, reduces electrical power consumption. According to certain embodiments of the present invention, the output of one of the above-discussed light sources is sampled for approximately 0.4 millisecond every nine seconds. Then, according to some of these embodiments, the microprocessor 120 processes the output voltage samples of the light source in accordance with instructions stored in the Electrically Erasable Programmable Read-Only Memory (EEPROM) 122 to determine whether an alarm condition exists or whether the optical electronics are within pre-assigned operational tolerances.

In the embodiment of the present invention illustrated in FIG. 13, one or more of the output voltage samples of an analog sensor 162 (e.g., a photodiode) is delivered through a sensor preamplifier 164 to a variable integrating analog-to-digital converter subcircuit 166. The representative converter subcircuit 166 illustrated in FIG. 13 takes an output voltage sample and integrates it during an integration time interval set during the alarm threshold calibration step discussed with reference to the process block 140 of FIG. 11. Upon conclusion of each integration time interval, the subcircuit 166 converts to a digital value the analog voltage representative of the photodiode output voltage sample taken.

The microprocessor 120 illustrated in FIG. 13 receives and, as described above, adjusts the digital values of ADJ_DATA and NEW_AIR. The microprocessor 120 then compares these values to the alarm voltage and sensitivity tolerance limit voltage established and stored in the EEPROM 122 during calibration. The process of adjusting the integrator voltages presented by the subcircuit 166 is commonly carried out by the microprocessor 120 in accordance with an algorithm implemented as instructions stored in the EEPROM 122. Representative processing steps of such an algorithm have been described above with reference to FIG. 12.

Generally, the microprocessor 120 illustrated in FIG. 13 causes continuous illumination of a visible light-emitting diode (LED) 168 to indicate an alarm condition and performs a manually operated self-diagnosis test in response to an operator's activation of a reed switch 170. A clock oscillator 172, which is commonly a part of the clock oscillator and wake-up circuit 126 illustrated in FIG. 10, is also typically included. The clock oscillator 172 according to certain embodiments of the present invention, has an output frequency of approximately 500 kHz and provides the timing standard for the overall operation of the circuit 160.

Figure 14:
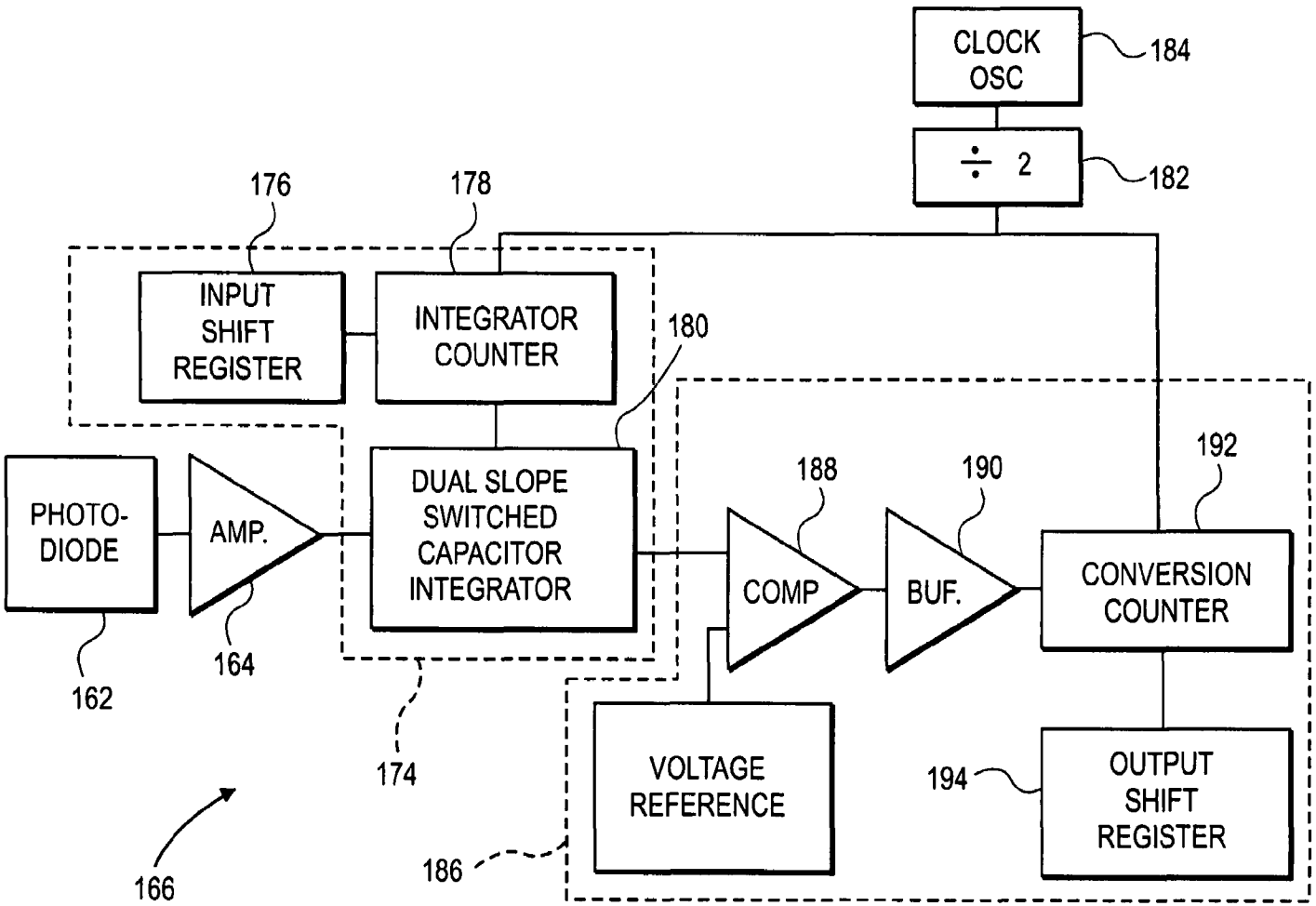
FIG. 14 is a block diagram showing in greater detail the components of the variable integrating analog-to-digital converter subcircuit illustrated in FIG. 13.

FIG. 14 is a block diagram showing in greater detail the components of the variable integrating analog-to-digital converter subcircuit 166 illustrated in FIG. 13. The following is a description of operation of a converter subcircuit 166 according to certain embodiments of the present invention, with particular focus on the processing the subcircuit 166 carries out during calibration to determine the integration time interval.

With reference to FIGS. 13 and 14, the representative preamplifier 164 illustrated therein conditions the output voltage samples of the analog sensor or photodiode 162 and delivers them to a programmable integrator 174 that includes an input shift register 176, an integrator up-counter 178 and a dual-slope switched capacitor integrator 180. During each 0.4 millisecond sampling period, an input capacitor of the integrator 180 accumulates the voltage appearing across the output of the preamplifier 164. The integrator 180 then transfers the sample voltage acquired by the input capacitor to an output capacitor.

At the start of one or more integration time interval, according to certain embodiments of the present invention, the shift register 176 receives, under control of the microprocessor 120, an 8-bit serial digital word representing the integration time interval. In some instances, the least significant bit corresponds to approximately 9 millivolts, with approximately 2.3 volts representing the full scale voltage for the 8-bit word. The shift register 176 typically provides as a preset to the integrator up-counter 178 the complement of the integration time interval word.

A 250 kHz clock produced at the output of a divide-by-two counter 182 driven by 500 kHz clock oscillator 184 may be used to cause the integrator up-counter 178 to count up to zero from the complemented integration time interval word. The time during which the up-counter 178 counts typically defines the integration time interval during which the integrator 180 accumulates across an output capacitor an analog voltage representative of the photodetector output voltage sample acquired by the input capacitor. The value of the analog voltage stored across the output capacitor is generally determined by the output voltage of the photodiode 162 and the number of counts stored in the integrator counter 178.

Upon completion of the integration time interval, the integrator up-counter 178 usually stops counting at zero. An analog-to-digital converter 186 then converts to a digital value the analog voltage stored across the output capacitor of the integrator 180. The analog-to-digital converter 186 commonly includes a comparator amplifier 188 that receives at its non-inverting input the integrator voltage across the output capacitor and at its inverting input a reference voltage which, according to certain embodiments of the present invention, is 300 millivolts, a system virtual ground.

According to certain embodiments of the present invention, a comparator buffer amplifier 190 conditions the output of the comparator 188. The amplifier 190 also provides a count enable signal to a conversion up-counter 192, which begins counting up after the integrator up-counter 178 stops counting at zero and continues to count up as long as the count enable signal is present.

During analog-to-digital conversion, the integrator 180 generally discharges the voltage across the output capacitor to a third capacitor while the conversion up-counter 192 continues to count. Such counting continues, according to certain embodiments of the present invention, until the integrator voltage across the output capacitor discharges below the +300 millivolt threshold of the comparator 188, thereby causing the removal of the count enable signal. The contents of the conversion up-counter 192 are then shifted to an output shift register 194, which, in some instances, provides to the microprocessor 120 an 8-bit serial digital word representative of the integrator voltage for processing in accordance with the mode of operation of the smoke detector system. Such modes of operation usually include the previously described in-service self-diagnosis, calibration and self-test.

During calibration, the smoke detector system commonly determines the measured sensor output in clean air to establish CLEAN_AIR, which is usually stored in the EEPROM 122. As indicated by the process block 140 of FIG. 11, a 2.5%/ft obscuration alarm threshold level may, for example, be established as a factor of NEW_AIR and stored in the EEPROM 122. Because different photodiodes and other light sensors differ somewhat in their output voltages, determining the integration time interval that produces an integrator voltage equal to the alarm voltage sets the CLEAN_AIR reference of the system. Thus, different counting time intervals for the integrator up-counter 180 produce different integrator voltages stored in the shift register 194.

A smoke detector having self-diagnostic and self-adjustment capabilities can be constructed to have an extended, cleaning- and maintenance-free operational life of, for example, approximately 20 years. Such a smoke detector, which is described below with reference to the smoke detector 92 illustrated in FIG. 9, may be implemented with a high precision floating background adjustment and, optionally, with synchronous detection.

The high precision floating background adjustment may, for example, be accomplished by substituting a 10-bit A/D converter for the A/D converter included in the signal acquisition unit 130 and performing 10-bit processing of RAW_DATA. The additional two bits provides a four-fold increase in drift compensation precision capability and thereby extends the smoke detector lifetime during which no cleaning need be performed.

Synchronous detection entails causing the microprocessor 120 to activate the smoke sensing element 104 to take in ON-OFF sampling sequence time-displaced groups of smoke samples and to average them to eliminate from RAW_DATA background noise present in the detection chamber. Sources of noise include interference from external light, RF emissions and other sources of background noise. Such an ON-OFF sampling sequence can be performed by activating the smoke sensing element 104 to take, for example, burst groups of twelve successive samples, with adjacent burst groups separated by approximately 9 seconds. The ON interval represents the time the twelve samples are taken when a light source such as, for example, any of the light sources illustrated in FIGS. 1-7, emits light, and the OFF interval represents the time between adjacent ON intervals when the light source does not emit light.

The group of twelve samples taken in the ON sampling interval provides detector values representing chamber background noise and light signal, and the OFF sampling interval provides detector values representing chamber background noise. Because background noise is common to ON interval values and OFF interval values, computing average ON and OFF interval values and subtracting the average interval values gives a corrected signal value with background noise removed. The noise-corrected signal value would represent one of the RAW_DATA for processing. The above represents one type of signal conditioning that can take place in the signal acquisition unit 130 illustrated in FIG. 10.

Because, as discussed above, detectors according to the present invention can be designed to be substantially immune to high rates of airflow and/or to be tolerant of dirt, dust and other contaminants, they may be used to detect smoke in air ducts and air vents. More specifically, any of the smoke sensing chambers illustrated in FIGS. 1-7 may be used in a smoke detector that is positioned in an air duct and may detect smoke particles therein using one or more of the methods discussed above.

What is claimed is:

1. A smoke detector, comprising:

a first light source configured to emit, from a first area thereon, light in a first wavelength range;

a first light sensor configured to detect the light in at least the first wavelength range;

a reflective surface configured to focus the light in the first wavelength range onto a second area that includes the first light sensor, wherein the second area is larger than the first area; and a second light source configured to emit, from a third area thereon, light in a second wavelength range, wherein the reflective surface is configured to focus the light in the second wavelength range onto a fourth area that includes the first light sensor, and wherein the fourth area is larger than the third area.

2. The smoke detector of claim 1, wherein the first wavelength range includes at least one of infra-red wavelengths and near infrared wavelengths.

3. The smoke detector of claim 1, wherein the first wavelength range includes ultraviolet wavelengths.

4. The smoke detector of claim 1, wherein the first wavelength range includes at least one of blue wavelengths and green wavelengths.

5. The smoke detector of claim 1, wherein the second light source is configured to emit light in the first wavelength range onto the reflective surface.

6. The smoke detector of claim 1, further comprising: a second light sensor configured to detect the light in the second wavelength range.

7. The smoke detector of claim 1, further comprising self-calibration circuitry configured to automatically calibrate the detector.

8. The smoke detector of claim 1, further comprising:

a light barrier positioned between the first light source and the first light sensor, wherein the light barrier is opaque to the light in the first wavelength range.

9. The smoke detector of claim 1, further comprising:

an electronic component positioned between the first light source and the first light sensor.

10. The smoke detector of claim 1, wherein the first light source, the first light sensor and the reflective surface are mounted on a single surface.

11. The smoke detector of claim 1, further comprising:

a shroud substantially surrounding the first light sensor, wherein the shroud is opaque to the light in the first wavelength range.

12. The smoke detector of claim 1, further comprising:

a gas absorption sensor positioned adjacent to the light source.

13. A method of monitoring smoke concentration, the method comprising:

emitting light in a first wavelength range from a first area on a first light source;

focusing the light in the first wavelength range onto a second area, wherein the second area is larger than the first area and includes a first light sensor;

detecting how much of the light in the first wavelength range reaches the first light sensor;

emitting light in a second wavelength range from a third area on a second light source;

focusing the light in the second wavelength range onto a fourth area, wherein the fourth area is larger than the third area and includes the first light sensor; and detecting how much of the light in the second wavelength range reaches the first light sensor.

14. The method of claim 13, further comprising:

automatically compensating for signal loss due to accumulation of particles over time.

15. The method of claim 13, further comprising:

automatically compensating for changes in intensity of the light from the first light source over time.

16. The method of claim 13, further comprising:

automatically compensating for changes in sensitivity of the first light sensor over time.

17. The method of claim 13, further comprising:

determining sizes of particles present in a first volume positioned between a mirror and the first light sensor and in a second volume positioned between the mirror and the first light source; and distinguishing between at least two of flaming fires, smoldering fires and steam at least partially based on the sizes of the particles determined.

18. The method of claim 17, wherein the distinguishing step is also partially based on a rate of change in how much of the light in the first wavelength range reaches the first light sensor.

19. The method of claim 13, further comprising:

detecting concentration of a gas present in a first volume positioned between a mirror and the first light sensor and a second volume positioned between the mirror and the first light source.

20. The method of claim 13, wherein the emitting step occurs on an intermittent basis and wherein the method further comprises:

recording a first light intensity value when the first light source is emitting the light in the first wavelength;

recording a second light intensity value when the first light source is not emitting the light in the first wavelength; and subtracting the second light intensity value from the first light intensity value to obtain a measured value.

21. A method of monitoring smoke concentration, comprising:

emitting light, on an intermittent basis, in a first wavelength range from a first area on a first light source;

focusing the light in the first wavelength range onto a second area, wherein the second area is larger than the first area and includes a first light sensor;

detecting how much of the light in the first wavelength range reaches the first light sensor;

recording a first plurality of measurement values at times when the first light source is emitting the light in the first wavelength;

recording a second plurality of measurement values at times when the first light source is idle;

subtracting the second plurality of measurement values from the first plurality of measurement values to obtain a plurality of measured values; and averaging the plurality of measured values to obtain a single measured value.

22. The method of claim 13, further comprising:

collecting a first smoke concentration value at a first time and a second smoke concentration value at a second time; and setting off an alarm when the first smoke concentration value differs from the second smoke concentration by at least a predetermined threshold value.

23. The method of claim 13, wherein the reflecting step is performed in an air duct.

* * * * *

UNITED STATES PATENT AND TRADEMARK OFFICE

CERTIFICATE OF CORRECTION

PATENT NO. : 7,564,365 B2
APPLICATION NO. : 11/389746
DATED : July 21, 2009
INVENTOR(S) : Marman et al.

It is certified that error appears in the above-identified patent and that said Letters Patent is hereby corrected as shown below:

In Column 6, Line 1, delete "V," and insert -- UV, --, therefor.

Signed and Sealed this

Twenty-ninth Day of September, 2009

David J. Kappos

David J. Kappos
*Director of the United States Patent and Trademark Office*